US012716701B2

(12) United States Patent
Glezer et al.

(10) Patent No.: US 12,716,701 B2
(45) Date of Patent: Aug. 25, 2026

(54) REGULATION OF AERODYNAMIC LOADS ON AIRCRAFT AND MISSILES USING AZIMUTHALLY-CONTROLLABLE, SEGMENTED AERODYNAMIC FOREBODY BLEED ACTUATION

(71) Applicant: Georgia Tech Research Corporation, Atlanta, GA (US)

(72) Inventors: Ari Glezer, Atlanta, GA (US); Bojan Vukasinovic, Atlanta, GA (US); Edward Lee, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 4 days.

(21) Appl. No.: 18/950,575

(22) Filed: Nov. 18, 2024

(65) Prior Publication Data

US 2026/0078990 A1 Mar. 19, 2026

Related U.S. Application Data

(60) Provisional application No. 63/600,532, filed on Nov. 17, 2023.

(51) Int. Cl.
*F42B 10/62* (2006.01)
*F42B 10/28* (2006.01)

(52) U.S. Cl.
CPC ..... *F42B 10/62* (2013.01); *F42B 10/28* (2013.01)

(58) Field of Classification Search
CPC ..... F42B 10/62; F42B 10/663
See application file for complete search history.

(56) References Cited

U.S. PATENT DOCUMENTS 2,836,378 A * 5/1958 Matthews ..... F42B 10/64 91/530
3,374,967 A * 3/1968 Plumley ..... F42B 10/661 244/3.22
4,522,357 A * 6/1985 Bains ..... F42B 10/663 244/3.22
4,531,693 A * 7/1985 Raynaud ..... B64C 15/14 244/3.22
4,589,594 A * 5/1986 Kranz ..... F42B 10/663 60/229
4,685,639 A * 8/1987 Bains ..... F42B 10/663 244/3.22

(Continued)

*Primary Examiner* — Joshua J Michener
*Assistant Examiner* — Cindi M Curry
(74) *Attorney, Agent, or Firm* — TROUTMAN PEPPER LOCKE LLP; Ryan A. Schneider; Nicholas H. Doss

(57) ABSTRACT

The present disclosure generally relates to systems and methods for controlling aerodynamic loads on an aerostructure. The present disclosure can include a system including an outer shell, the outer shell including at least one aperture, and an inner shell having an aperture therethrough. The at least one aperture of the outer shell can be part of an array of apertures azimuthally distributed on the outer shell. The system can further include an actuator configured to control a rotational alignment of one of the inner shell and the outer shell to alter aerodynamic bleed through a portion of the at least one aperture of the outer shell. The actuator can be configured alter the rotational alignment of the inner shell and the outer shell based at least in part on a desired steering direction of the aerostructure.

20 Claims, 8 Drawing Sheets

(56) References Cited

U.S. PATENT DOCUMENTS

| | | | | |
|---|---|---|---|---|
| 6,685,143 | B1 * | 2/2004 | Prince | F42B 10/64 244/203 |
| 2009/0084888 | A1 * | 4/2009 | Shai | F42B 10/663 244/3.22 |
| 2012/0187235 | A1 * | 7/2012 | Bergmann | F42B 10/663 244/3.22 |
| 2018/0050825 | A1 * | 2/2018 | Ramsel | F02K 9/68 |

* cited by examiner

REGULATION OF AERODYNAMIC LOADS ON AIRCRAFT AND MISSILES USING AZIMUTHALLY-CONTROLLABLE, SEGMENTED AERODYNAMIC FOREBODY BLEED ACTUATION

CROSS-REFERENCE TO RELATED APPLICATIONS

This application claims the benefit of U.S. Provisional Application Ser. No. 63/600,532, filed on Nov. 17, 2023, which is incorporated herein by reference in its entirety as if fully set forth below.

GOVERNMENT LICENSE RIGHTS

This invention was made with government support under W911NF-19-2-0233 awarded by the Army Research Laboratory—Army Research Office. The government has certain rights in the invention.

FIELD OF THE DISCLOSURE

The various embodiments of the present disclosure relate generally to systems and methods for controlling aerodynamic loads on aircrafts, missiles, and the like, and more particularly to controlling aerodynamic loads on aerostructures via altering aerodynamic bleed.

BACKGROUND

The flow and aerodynamic loads over missiles and aircraft forebodies are dominated by interactions of a hierarchy of vortical structures in the platform wake of its forebody, main, and aft segments. The complexity of these separated vortical flows intensifies with increasing inclination angle and commence with the rollup and evolution of counter-rotating forebody vortex pair and continues with their subsequent convective interactions with the shear layers that bound the near wake on the leeward side of the platform. Extensive investigations have demonstrated that these vortices are typically affected by minor surface perturbations and thus are prone to asymmetric evolution and high incidences. The uneven intensification and detachment of the forebody vortices causes significant side forces and yawing moments that can adversely affect flight stability but can also be exploited for aerodynamic maneuvering by controlling their evolution without using moving control surfaces.

Subsequent investigations focused on control of the loads on higher aspect ratio axisymmetric bodies at moderate incidence where the loads are dominated by the formation, evolution, and dynamics of the forebody counter-rotating vortex pairs. These investigations utilized wire-mounted axisymmetric slender cylinder models that were initially integrated with azimuthal individually-controlled synthetic jets and later on with a unique forebody actuator for dynamic, azimuthally-controlled aerodynamic bleed.

The interactions between the actuation and the cross flow and their coupling to the stability of the near wake were investigated using high-speed stereo PIV, a motion analysis system, and time-resolved measurements of aerodynamic forces and moments. The earlier investigations showed that asymmetric rollup of the forebody counter-rotating vortices at high angles of attack induces corresponding strong side forces and demonstrated that fluidic actuation near the forebody can effectively control the induced side forces and stabilize (or destabilize) yaw oscillations owing to coupling between the body and its near wake. Accordingly, there is currently a need to better control forebody vortices, as well as regulate side forces experienced by an aerostructure about a neutral operating point.

BRIEF SUMMARY

An exemplary embodiment of the present disclosure provides a system for controlling aerodynamic loads on an aerostructure, including: an outer shell including at least one aperture; an inner shell having an aperture therethrough, the aperture extending azimuthally around a portion of the inner shell; and an actuator configured to control a rotational alignment of the inner shell and the outer shell to alter aerodynamic bleed through at least a portion of at least one aperture of the outer shell.

In any of the embodiments disclosed herein, the actuator can include a motor configured to axially rotate at least one of the inner shell and the outer shell.

In any of the embodiments disclosed herein, the outer shell can be rotationally fixed to the aerostructure, and the motor can be configured to axially rotate the inner shell with respect to the outer shell.

In any of the embodiments disclosed herein, the outer shell can be disposed on an end of the aerostructure.

In any of the embodiments disclosed herein, at least one aperture of the outer shell can be part of an array of apertures azimuthally distributed on the outer shell.

In any of the embodiments disclosed herein, at least one aperture of the outer shell can include at least one straight edge, and the aperture of the inner shell can include at least one straight edge, such that the at least one straight edge of the outer shell can be configured to align with the at least one straight edge of the inner shell.

In any of the embodiments disclosed herein, the array of apertures can include a first row of apertures and a second row of apertures. At least one aperture of the first row can be aligned with at least one aperture of the second row substantially parallel to a longitudinal axis of the aerostructure.

In any of the embodiments disclosed herein, the actuator can be configured to cause the inner shell to transition between a first rotational alignment with the outer shell in which the inner shell may block aerodynamic bleed through at least a portion of at least one aperture of the outer shell and a second rotational alignment with the outer shell in which the inner shell may allow aerodynamic bleed through the at least a portion of the at least one aperture of the outer shell.

In any of the embodiments disclosed herein, the actuator can be configured to control the rotational alignment of the inner shell and the outer shell based at least in part on a side force component from a fluid flow on the aerostructure.

In any of the embodiments disclosed herein, at least one aperture of the outer shell can be part of a plurality of apertures spanning a top azimuthal portion of the outer shell.

In any of the embodiments disclosed herein, the inner shell can be part of a plurality of inner shells which may include a first inner shell and a second inner shell, wherein the first inner shell and the second inner shell can overlap thereby forming a relative azimuthal aperture.

In any of the embodiments disclosed herein, the actuator can be selected from a group consisting of: a rotary motor, an inflatable actuator, piezoelectric plates, and an electrostatic actuator.

In any of the embodiments disclosed herein, the actuator can be configured to automatically control the rotational alignment of the inner shell and the outer shell based at least in part on a desired steering direction of the aerostructure.

An exemplary embodiment of the present disclosure provides an aerostructure including a substantially cylindrical body; and a forebody section including an outer shell including an array of apertures; and an inner shell having one or more apertures therethrough, the one or more apertures extending azimuthally around a portion of the inner shell; and an actuator configured to control a rotational alignment of the inner shell and outer shell, such that the rotational alignment is configured to alter aerodynamic bleed through at least a portion of at least one aperture of the outer shell. an actuator configured to control a rotational alignment of the inner shell and outer shell, such that the rotational alignment is configured to alter aerodynamic bleed through at least a portion of at least one aperture of the outer shell.

In any of the embodiments disclosed herein, the forebody section can further include a gap disposed between the outer shell and the inner shell.

In any of the embodiments disclosed herein, the outer shell and the inner shell can be hollow, such that the forebody section can further include a compartment disposed at least partially within the inner shell.

In any of the embodiments disclosed herein, the inner shell can be part of a plurality of inner shells including a first inner shell and a second inner shell, wherein the first inner shell and the second inner shell can overlap thereby forming a relative azimuthal aperture.

An exemplary embodiment of the present disclosure provides a method of controlling aerodynamic loads on an aerostructure, the aerostructure including an outer shell, the outer shell including at least one aperture, and an inner shell having an aperture therethrough, the aperture extending azimuthally around a portion of the inner shell, the method including placing the aerostructure in motion, such that the aerostructure experiences aerodynamic loads; and altering a rotational alignment of the inner shell with respect to the outer shell to alter aerodynamic bleed through at least one aperture of the outer shell.

In any of the embodiments disclosed herein, altering the rotational alignment of the inner shell with respect to the outer shell can include substantially nullifying effects of side forces and yawing moments via a first rotational alignment adjustment; determining a desired directional change of the aerostructure; and making a second rotational alignment adjustment based at least in part on the desired directional change of the aerostructure.

In any of the embodiments disclosed herein, altering the rotational alignment of the inner shell with respect to the outer shell to alter aerodynamic bleed through at least one aperture of the outer shell can include altering an azimuthal position of the aperture of the inner shell.

These and other aspects of the present disclosure are described in the Detailed Description below and the accompanying drawings. Other aspects and features of embodiments will become apparent to those of ordinary skill in the art upon reviewing the following description of specific, exemplary embodiments in concert with the drawings. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

The following detailed description of specific embodiments of the disclosure will be better understood when read in conjunction with the appended drawings. For the purpose of illustrating the disclosure, specific embodiments are shown in the drawings. It should be understood, however, that the disclosure is not limited to the precise arrangements and instrumentalities of the embodiments shown in the drawings.

DETAILED DESCRIPTION

Figure 1:
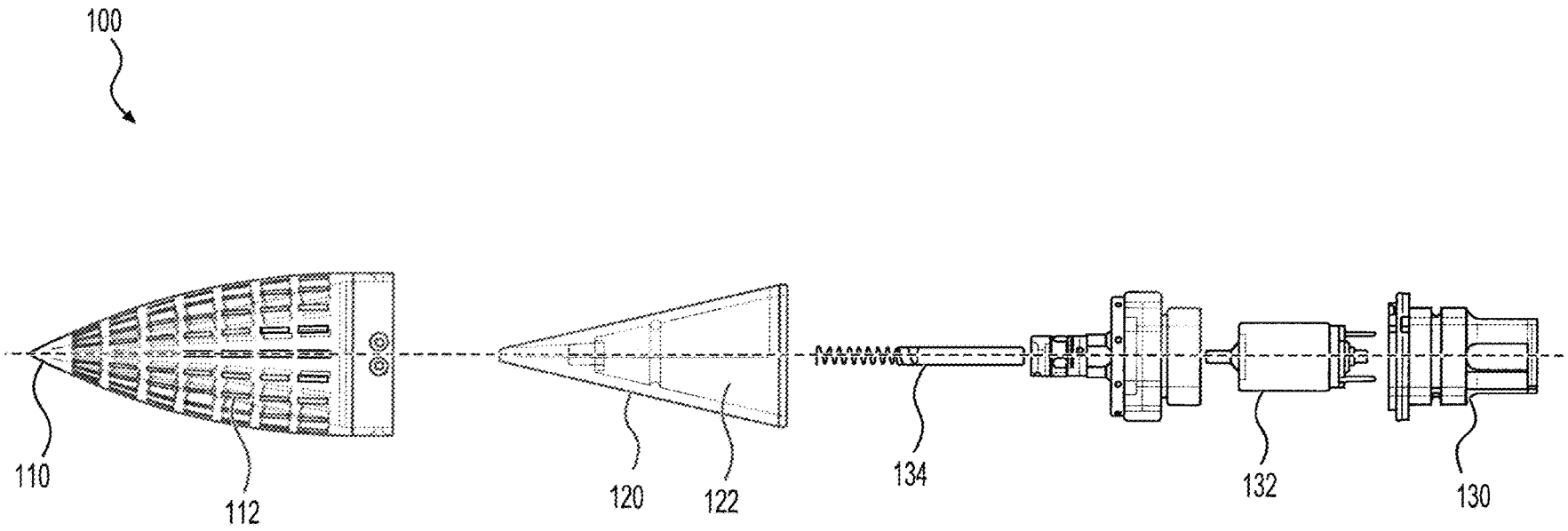
FIG. 1 provides an exploded side view of a system for controlling aerodynamic loads on an aerostructure, in accordance with some embodiments of the present disclosure.

To facilitate an understanding of the principles and features of the present disclosure, various illustrative embodiments are explained below. The components, steps, and materials described hereinafter as making up various elements of the embodiments disclosed herein are intended to be illustrative and not restrictive. Many suitable components, steps, and materials that would perform the same or similar functions as the components, steps, and materials described herein are intended to be embraced within the scope of the disclosure. Such other components, steps, and materials not described herein can include, but are not limited to, similar components or steps that are developed after development of the embodiments disclosed herein.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Referring now to the drawings, in which like numerals represent like elements, the present disclosure is herein described. FIG. 1 illustrates a system 100 for controlling loads on an aerostructure. The aerostructure can be many aerostructures known in the art, including, but not limited to, planes, shuttles, missile projectiles, and the like, or one or more portions thereof. The system 100 may include an outer shell 110 such that the outer shell 110 includes an aperture 112. In some embodiments, the outer shell 110 can include at least one aperture 112 or multiple apertures 112. The aperture 112 may be part of an array of apertures, which, as will be discussed in greater detail herein, may be azimuthally distributed about the outer shell. The outer shell 110, as shown in FIG. 1, may be disposed at an end of the aerostructure. For example, the outer shell 110 can be part of a forebody section of the aerostructure. The system 100 can further include an inner shell 120 including an aperture 122 therethrough. In some embodiments, the inner shell 120 can be part of one or more inner shells, as will be discussed in greater detail herein. The aperture 122 of the inner shell 120 can extend azimuthally around a portion of the inner shell 120. The system 100 can further include an actuator 132. The actuator 132, in some embodiments, can be configured to control a rotational alignment of the inner shell 120 and the outer shell 110 to alter aerodynamic bleed through at least a portion of at least one aperture 112 of the outer shell 110. That is, the actuator 132, in some embodiments, can control a rotational alignment of the inner shell 120 with respect to the outer shell 110. Further, the actuator 132, in some embodiments, can be configured to alter aerodynamic bleed through the aperture 112 of the outer shell 110. For example, the actuator 132 can be a motor. The motor can be configured to axially rotate at least one of the inner shell 120 and the outer shell 110. In this way, the motor can be a rotary motor, which, as will be appreciated, can be configured to alter the rotational alignment of the inner shell 120 and the outer shell 110. In some embodiments, the outer shell 110 can be rotationally fixed, and actuator 132 can be configured to axially rotate the inner shell 120 with respect to the outer shell 110. The actuator 132 can be configured to be housed by a housing 130, such that the housing 130 may couple the actuator 132 to other mechanical elements, the aerostructure, a power source, etc. For example, the housing 130 can be configured to couple the actuator 132 to a shaft 134. The shaft 134 may be configured to be coupled to any of the inner shell 120, the outer shell 110, the housing 130, and the actuator 132. That is, the actuator 132 may be coupled to the housing 130, which may be coupled to the shaft 134, which may be coupled to the inner shell 120. In this way, the actuator 132 can provide a rotary force, or moment, to the shaft 134, such that the actuator 132 can be configured to rotate the shaft 134 and thus be configured to rotate one of the inner shell 120 and the outer shell 110.

Aerodynamic bleed, or peripheral bleed, in the context of the present disclosure can be understood as altering fluid flow based on a difference in pressure. More specifically, aerodynamic bleed can be defined as flow driven solely by pressure differences across aerodynamic surfaces in flight. That is, a pressure external to one segment of the outer shell 110 and a pressure external to a different segment of the outer shell 110 may differ, causing a fluid to flow into the outer shell 110 through a segment of higher pressure and out of the outer shell 110 through a segment of lower pressure. In some embodiments, as can be appreciated, the segment of lower pressure can be downstream from the segment of higher pressure. Consequently, the flow into and out of the outer shell 110 as discussed herein can occur regardless of the rotational alignment of the inner shell 120 and the outer shell 110. In some embodiments, the system 100 can further include a gap disposed between the inner shell 120 and the outer shell 110. That is, the fluid can flow into the segment of higher pressure, through the gap, and out of the segment of lower pressure of the outer shell 110. In this way, flow characteristics of the flow into and out of the outer shell 110 can be altered based at least in part on the rotational alignment of the inner shell 120 and the outer shell 110. Thus, in discussion of aerodynamic bleed being altered by a rotational alignment of the outer shell 110 and the inner shell 120, what can be appreciated is that the rotational alignment of the outer shell 110 and the inner shell 120 can affect the fluid flow about the outer shell 110. As will be discussed in greater detail herein, the inner shell 120 can include an aperture therethrough, in which the aperture can extend azimuthally around a portion of the inner shell 120. As is understood by those skilled in the art, flow characteristics of the fluid flowing in and out of the outer shell 110 can be altered based at least in part on whether the fluid flow is aligned with the inner shell 120, and thus flows through at least the gap between the outer shell 110 and the inner shell 120, or the aperture of the inner shell 120. In this way, in the instance of side forces and yawing moments, fluid may flow through the outer shell 110 and the inner shell 120 based on the alignment of an aperture of the inner shell 120 and the aperture 112 of the outer shell, as will be discussed in greater detail herein. Further, altering of the flow characteristics of the fluid flowing about an aerostructure, as can be appreciated, can be manually adjusted in order to induce a force on the aerostructure, or particularly, to steer the aerostructure. Thus, altering aerodynamic bleed as discussed herein can include altering the rotational alignment of the inner shell 120 and the outer shell 110, or any embodiments of one or more inner shells and an outer shell discussed herein.

Figure 2:
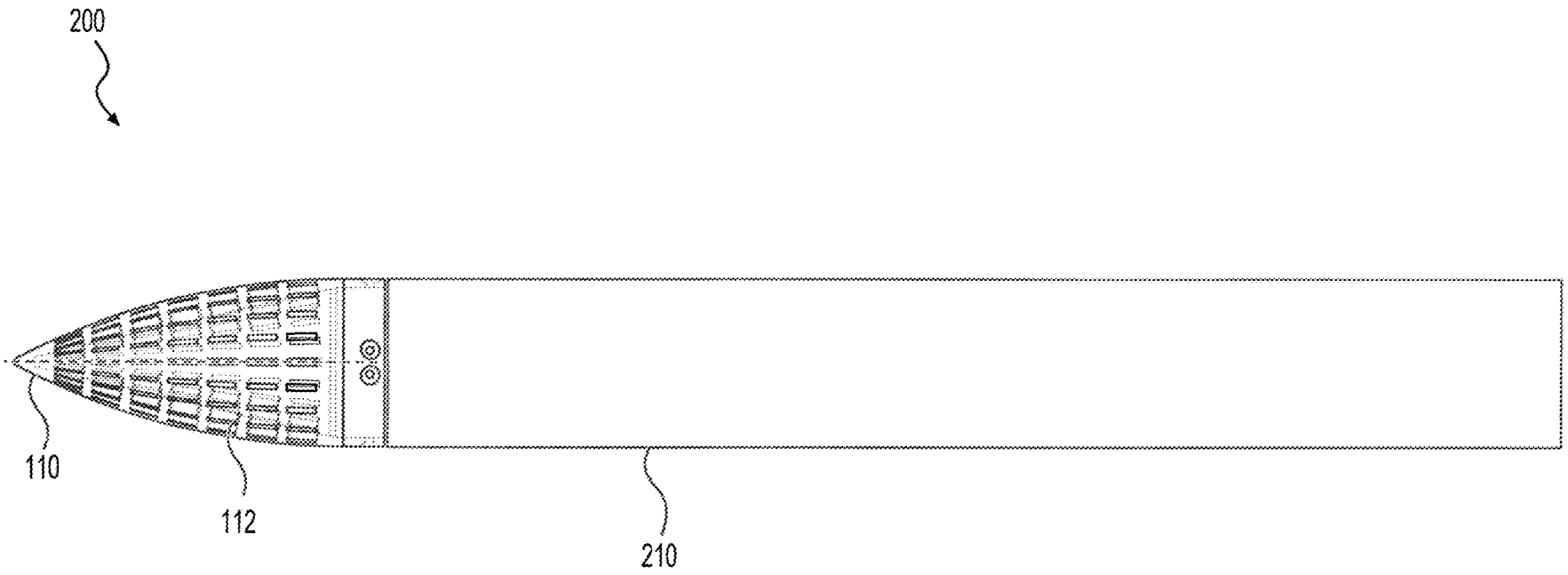
FIG. 2 provides a side view of an aerostructure including an outer shell including at least one aperture, in accordance with some embodiments of the present disclosure FIGS. 3A and 3B provide front views of one or more inner shells, in accordance with some embodiments of the present disclosure.

FIG. 2 illustrates an aerostructure 200 including at least the outer shell 110. In some embodiments, the aerostructure 200 can include the system 100. That is, the housing 130, the actuator 132, and the shaft 134 may be disposed within a main body 210 of the aerostructure 200. The main body 210 may include a shell, such that the shell may encapsulate components, such as elements of the system 100 discussed herein. As shown, the outer shell 110 can be located at a fore end of the aerostructure 200. That is, the outer shell 110 can be located in a forebody section of the aerostructure 200. In some embodiments, as discussed herein, the outer shell 110 can be rotationally fixed to the aerostructure 200, and the inner shell 120 can be configured to axially rotate with respect to the outer shell 110.

The inner shell 120, as discussed for FIG. 1, may be disposed at least partially within the outer shell 110. Accordingly, the outer shell 110 may be hollow, such that the outer shell 110 can be configured to house the inner shell 120 within. In some embodiments, the outer shell 110 can be characterized by a conical shape, as can be appreciated by those skilled in the art, so as to be aerodynamic when located in the forebody section of the aerostructure 200. In this way, when the aerostructure 200 is in motion, a fluid flow may pass through the aperture 112 of the outer shell 110. In some embodiments, the aperture 112 of the outer shell 110 can be configured to direct the fluid flow at least partially towards the inner shell 120. In this way, the aperture 112 of the outer shell 110 can be configured to create an aerodynamic bleed effect, such that at least part of the fluid flow can pass through the aperture 112. Further, when the aperture 112 is part of the plurality of apertures, as shown, the plurality of apertures can be configured to alter aerodynamic bleed. As will be discussed in greater detail herein, the aerodynamic bleed can be altered based at least in part on a rotational alignment of the outer shell 110 and the inner shell 120.

Figure 3A:
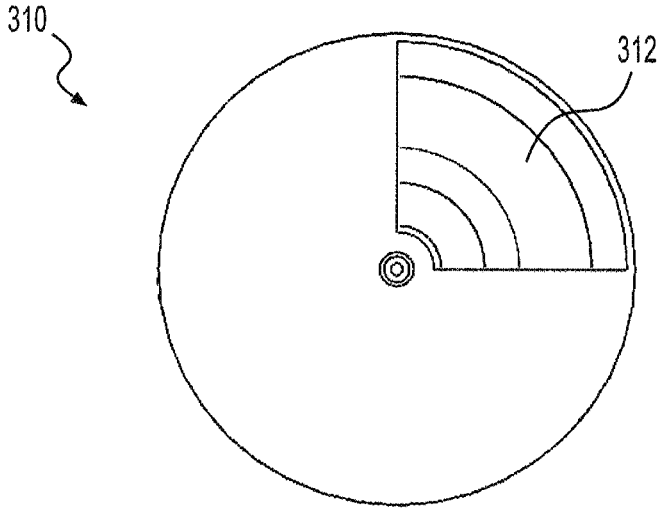
Figure 3B:
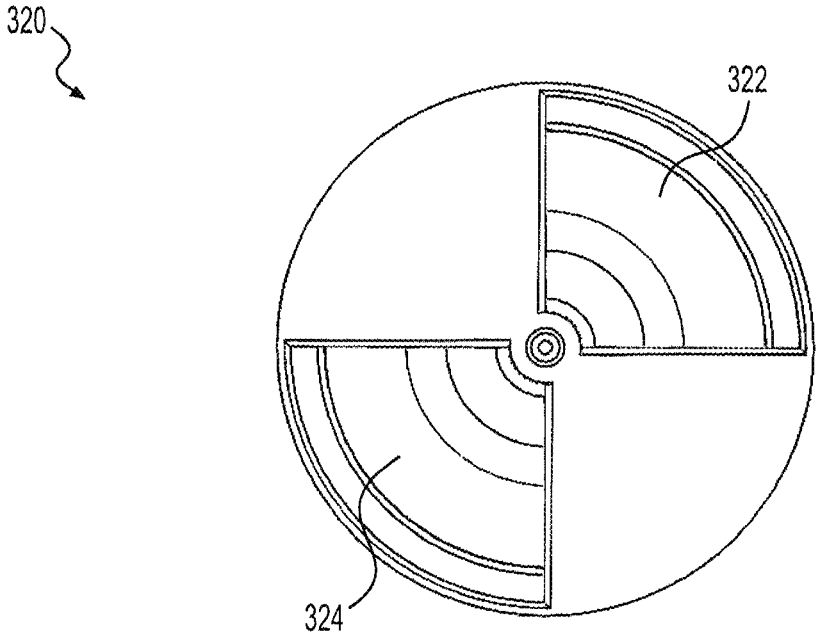

FIGS. 3A and 3B illustrate embodiments of one or more inner shells. As discussed herein, the inner shell 120 may be part of one or more inner shells. As shown in FIG. 3A, the one or more inner shells can have a first inner shell configuration 310. The first inner shell configuration 310, as will be appreciated, may include a single inner shell. In some embodiments, the first inner shell configuration 310 may include a plurality of inner shells. Nevertheless, regardless of the number of inner shells, the first inner shell configuration 310 can be characterized by having an aperture 312. The aperture 312 of the first inner shell configuration 310 can include any embodiment of the aperture 122 as discussed herein. The aperture 312 can extend azimuthally around a portion of the one or more inner shells. That is, the aperture 312 can be characterized by an azimuthal extension angle, defined as a number of azimuthal degrees which the aperture 312 may span. The azimuthal extension angle, in some embodiments, can be approximately 45 degrees, as shown. The azimuthal extension angle, in some embodiments can include any angle between approximately 5 degrees and approximately 270 degrees. As can be appreciated, the azimuthal extension angle and an azimuthal location of the aperture 312 can affect the aerodynamic bleed of an aerostructure. For example, if the inner shell 120 included the first shell configuration 310, an azimuthal position of the aperture 312 could be altered based at least in part on aerodynamic bleed. That is, aerodynamic bleed through at least a portion of at least one aperture of the outer shell 110 can be altered via altering the azimuthal position of the aperture 312 of the first inner shell configuration 310. In some embodiments, altering the azimuthal position of the aperture 312 includes altering the rotational alignment of the inner shell 120 with respect to the outer shell 110, which may be completed via actuator 132 as discussed herein.

As shown in FIG. 3B, the inner shell 120 can be configured to have a second inner shell configuration 320. The second inner shell configuration 320 can be characterized as including a first aperture 322 and a second aperture 324. The first aperture 322 and the second aperture 324, as discussed herein for embodiments of the aperture 312, may each extend azimuthally around a portion of the inner shell 120. The first aperture 322 and the second aperture 324, in some embodiments, may each be characterized by a respective azimuthal extension angle, as discussed for embodiments of the aperture 312, which may be substantially the same, as shown. In some embodiments, the azimuthal extension angle of the first aperture 322 may be greater than the azimuthal extension angle of the second aperture 324 by any degree value between approximately 5 degrees to approximately 45 degrees. In some embodiments, the second inner shell configuration 320 may include a plurality of inner shells. Further, the second inner shell configuration 320 may include a first inner shell and a second inner shell, such that the first inner shell can be positioned substantially concentrically to the second inner shell. In this way, the first aperture 322 and the second aperture 324 may be formed by gaps between portions of the first inner shell and the second inner shell. The first inner shell and the second inner shell, in some embodiments, may overlap thereby forming a relative azimuthal aperture. The relative azimuthal aperture, as can be appreciated, can be defined by azimuthal positions of the first aperture 322 and the second aperture 324.

Any of embodiments of inner shell discussed herein may be substantially conical. In this way, the inner shell 120, and other embodiments of inner shell discussed herein, may be at least partially disposed within the outer shell 110. In some embodiments, there may exist a gap between the outer shell 110 and the inner shell 120. As will be appreciated, the gap between the outer shell 110 and the inner shell 120 can be configured to improve changes in aerodynamic bleed incurred by changing the rotational alignment of the outer shell 110 and the inner shell 120. Additionally, the inner shell 120, and any embodiments of inner shell discussed herein, may be at least substantially hollow. In this way, the inner shell 120, or the one or more inner shells, may be configured to house a compartment within. That is, the aerostructure 200 may further include a compartment disposed at least partially within the inner shell 120. The compartment, as can be appreciated, can be utilized to store different components, subsystems, electronics, power sources, and similar elements known in the art for aerostructures. Furthermore, the compartment may be empty so as to reduce a weight of the aerostructure 200.

Figure 4A:
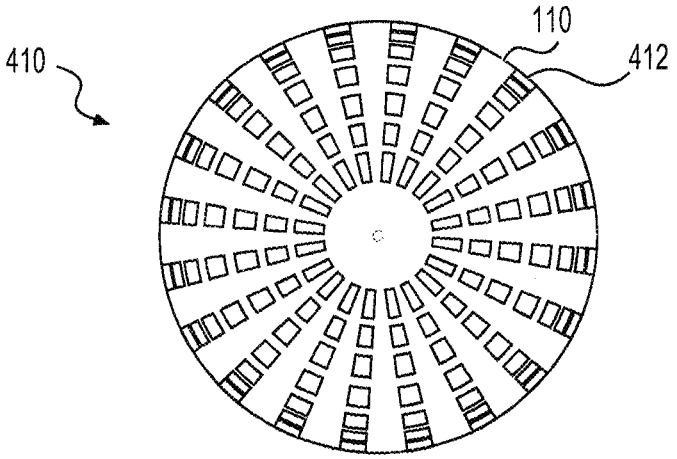
FIGS. 4A-C provide front views of configurations of an outer shell and one or more inner shells, in accordance with some embodiments of the present disclosure.
Figure 4B:
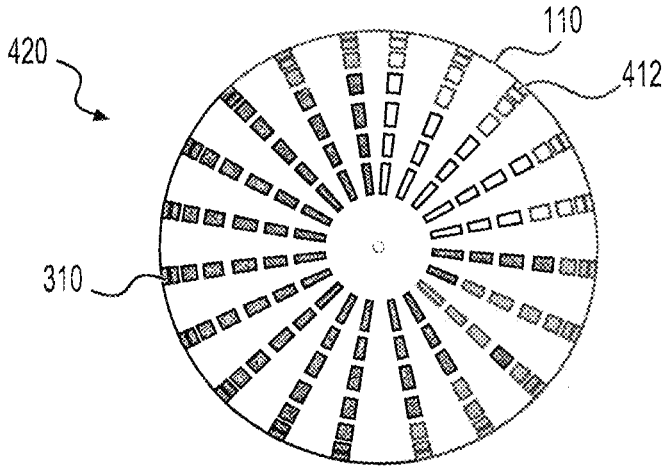
Figure 4C:
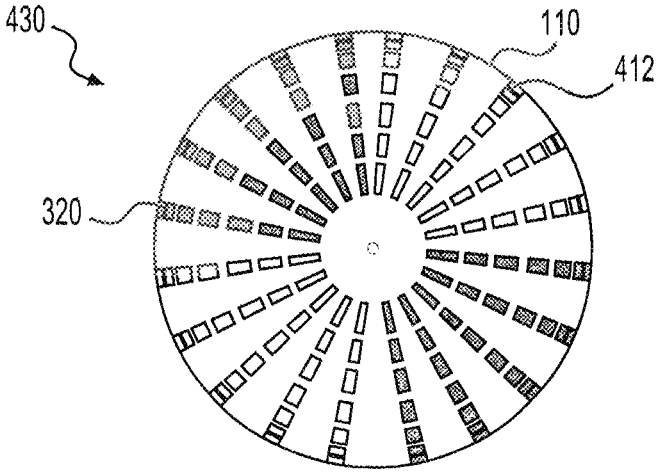

FIGS. 4A-C illustrate configurations of the outer shell 110. As shown in FIG. 4A, the outer shell 110 can include an array of apertures 412. As discussed herein, the array of apertures 412 may include the aperture 112. The array of apertures 412 can be azimuthally distributed on the outer shell 110. That is, the array of apertures 412 can include at least a first row of apertures and a second row of apertures. In some embodiments, at least one aperture of the first row of apertures can be aligned with at least one aperture of the second row of apertures. Furthermore, the at least one aperture of the first row of apertures can be aligned with the at least one aperture of the second row of apertures substantially parallel to a longitudinal axis of the aerostructure 200. The longitudinal axis can be defined as being substantially in a z-axis direction from the view provided in FIGS. 4A-C, as understood by those skilled in the art. In some embodiments, at least one aperture of the outer shell 110 can include at least one straight edge. Additionally, the inner shell 120 can include at least one straight edge, such that the at least one straight edge of the outer shell 110 can be configured to align with the at least one straight edge of the inner shell 120. As can be appreciated, aligning straight edges of overlapping shells can improve a speed of covering and uncovering apertures, which can be important for efficiency of the system 100. In some embodiments, each aperture of the array of apertures 412 can include at least one straight edge. In some embodiments, each aperture of the array of apertures 412 can be substantially rectangular, or prismatic. The rows of the array of apertures 412 can be aligned such that at least one straight edge of each aperture aligns with at least one other straight edge of another aperture in a different row of apertures along the longitudinal direction. As will be appreciated, alignment of straight edges of apertures in the array of apertures 412 can allow apertures to be covered more swiftly upon altering the rotational alignment of the inner shell 120 with respect to the outer shell 110. A speed of adjustment of the rotational alignment can improve performance of the aerodynamic bleed effect.

As shown in FIG. 4B, one or more inner shells including the first inner shell configuration 310 can be disposed at least partially within the outer shell 110. For clarity of FIGS. 4B and 4C, clear, or white apertures as shown indicate uncovered apertures, and shaded apertures indicate covered apertures. As described herein, "covered" can be interpreted as "blocked" and "uncovered" can be interpreted as "unblocked". In this way, when one or more inner shells having the first inner shell configuration 310 are disposed at least partially within the outer shell 110, the aperture 312 can be configured to align at least a portion of apertures of the array of apertures 412 such that fluid may flow through the at least portion of the array of apertures 412 and the aperture 312. Similarly, the one or more inner shells of the first inner shell configuration can be configured to align with a portion of apertures of the array of apertures so as to block the portion of apertures. Blocking apertures does not necessarily indicate a lack of fluid flow, however, as will be appreciated, fluid flow through the portion of apertures of the array of apertures 412 covered via the one or more inner shells may include different flow characteristics than fluid flow through the portion of apertures of the array of apertures 412 aligned with the aperture 312. In this way, characteristics of aerodynamic bleed may differ between covered and uncovered apertures of the array of apertures 412. Thus, altering the rotational alignment of the one or more inner shells with respect to the outer shell 110 may include altering which apertures of the array of apertures 412 are aligned with the aperture 312, such that an azimuthal position of the aperture 312 may affect aerodynamic bleed effects on forebody vortices, as discussed in greater detail herein.

As shown in FIG. 4C, one or more inner shells including the second inner shell configuration 320 can be disposed at least partially within the outer shell 110. In this way, when one or more inner shells having the second inner shell configuration 320 are disposed at least partially within the outer shell 110, the first aperture 322 and the second aperture 324 can be configured to align with at least a portion of apertures of the array of apertures 412, such that fluid may flow through the portion of the array of apertures 412, the first aperture 322, and the second aperture 324. Alignment of the first aperture 322 and the second aperture 324 with the portion of apertures of the array of aperture 412 can be of any embodiment of alignment as discussed herein. In some embodiments, the actuator 132 of the system 100 can be configured to alter a rotational alignment of the first aperture 322 with respect to array of apertures 412, with the second aperture 324 and its corresponding inner shell being fixed. Additionally, the actuator 132 of the system 100 can be configured to alter a rotational alignment of both the first aperture and the second aperture 324 with respect to the array of apertures 412.

Figure 5:
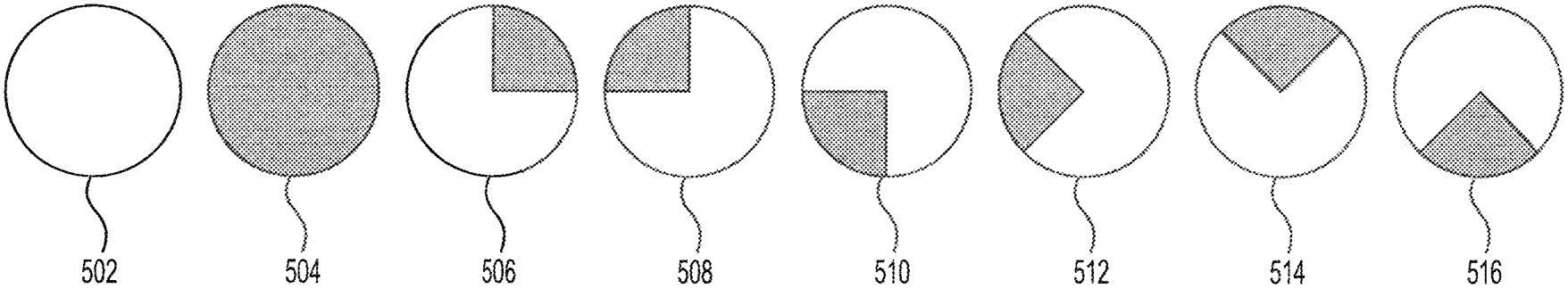
FIG. 5 provides a reference for defining an azimuthal position of the aperture of the one or more inner shells, in accordance with some embodiments of the present disclosure.

FIG. 5 illustrates configurations of covered and uncovered apertures of the array of apertures 412. That is, FIG. 5 illustrates configurations of azimuthal positions of the one or more apertures of the one or more inner shells with respect to the outer shell 110. As discussed herein for FIGS. 4B and 4C, shaded regions indicate an azimuthal position of the one or more apertures of the inner shell. For example, the array of apertures 412 can have a configuration 502, such that each aperture of the array of apertures is covered by the one or more inner shells. The configuration 502 can be such that when the first inner shell overlaps with the second inner shell, the first aperture 322 is covered by the second inner shell and the second aperture 324 is covered by the first inner shell. The array of apertures 412, in some embodiments, can have a configuration 504, such that each aperture of the array of apertures 412 can be uncovered. The configuration 504 can be effectively a 360 degree relative azimuthal aperture of the one or more inner shells, such that there may not be an inner shell disposed within the outer shell 110. The array of apertures 412, in some embodiments, can have a configuration 506, a configuration 508, a configuration 510, a configuration 512, a configuration 514, and a configuration 516 as shown. The configurations 506-516 illustrate potential azimuthal positions of the one or more apertures of the one or more inner shells. In some embodiments, the one or more inner shells can be configurated to be axially rotated to achieve any of the configurations 506-516.

Figure 6B:
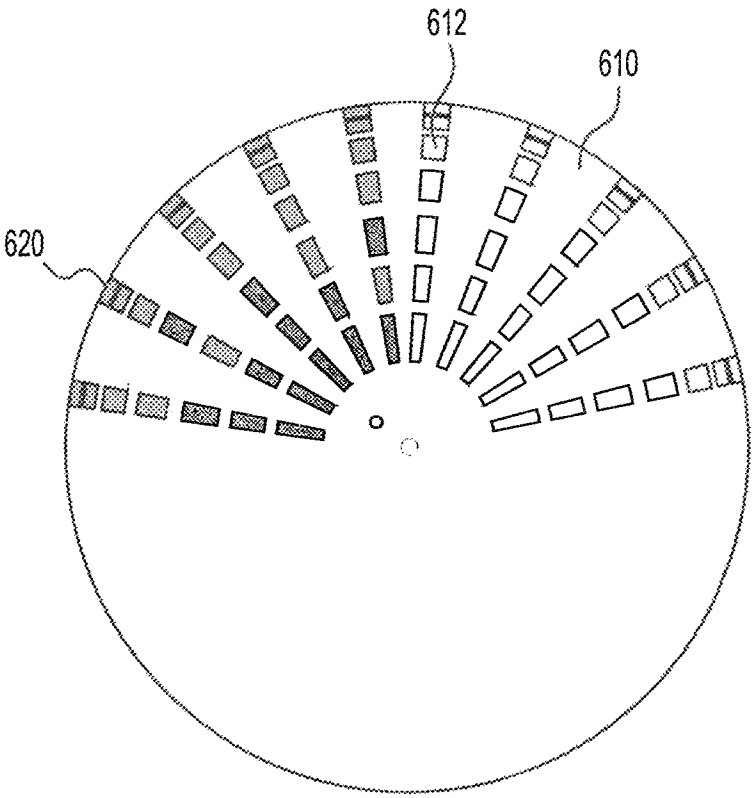
FIGS. 6A and 6B provide front views of configurations of an outer shell and one or more inner shells, in accordance with some embodiments of the present disclosure.
Figure 6A:
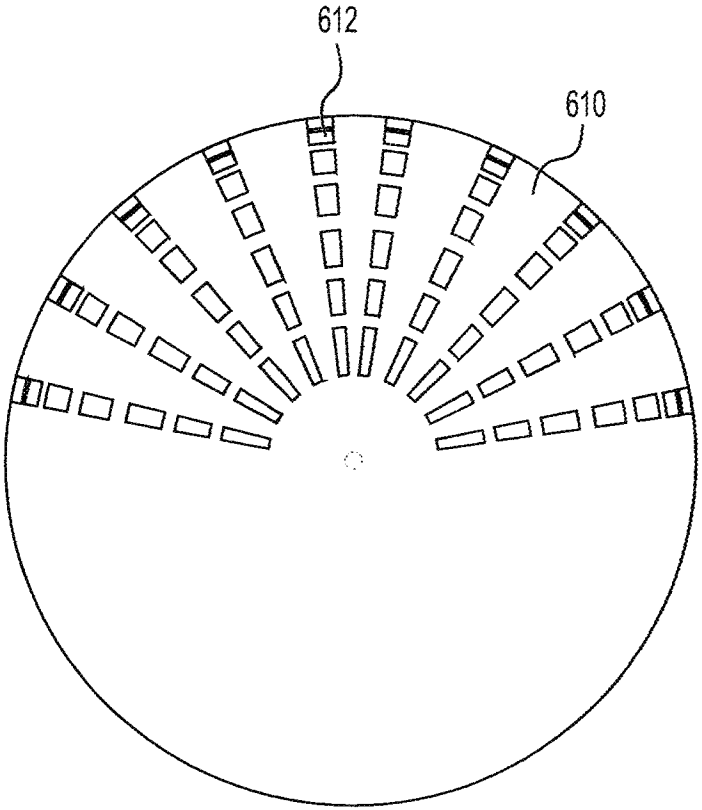

FIGS. 6A and 6B illustrate embodiments of an outer shell 610 including a plurality of apertures 612. As shown in FIG. 6A, the plurality of apertures 612 can span a top azimuthal portion of the outer shell 610. The top azimuthal portion, in some embodiments, can oppose a portion proximal to a ground plane during flight of an aerostructure including the outer shell 610. As can be appreciated, the aerostructure including the outer shell 610 may be configured to be steered to rotate about a longitudinal axis in flight, therefore the top azimuthal portion can be configured to be rotated about the longitudinal axis with the aerostructure. As will be discussed in greater detail herein, the aerostructure including the outer shell 610 may be configured to be steered via altering aerodynamic bleed through at least a portion of the plurality of apertures 612. The plurality of apertures 612, in some embodiments, can include embodiments of the aperture 112 discussed herein. Similarly, the plurality of apertures 612 can be in the form of an array of apertures, as discussed herein, being distributed about the top azimuthal portion of the outer shell 610. The top azimuthal portion, in some embodiments, can be defined as a top quarter azimuthal portion, a top third azimuthal portion, a top half azimuthal portion, a top two thirds azimuthal portion, a top three quarters azimuthal portion, or similar definitions of azimuthal portions. That is, the top azimuthal portion can be selected from a group consisting of: a top third azimuthal portion, a top half azimuthal portion, and a top two thirds azimuthal portion.

As shown in FIG. 6B, one or more inner shells can be disposed at least partially within the outer shell 610. In some embodiments, the plurality of apertures 612 can include a portion of covered apertures 620. That is, as discussed for portions of apertures herein, the portion of covered apertures 620 can align with the one or more inner shells such that aerodynamic bleed may be altered for the portion of covered apertures 620 as compared to a portion of the plurality of apertures 612 aligned with an aperture of the one or more inner shells. The one or more inner shells, as can be appreciated, may include any embodiments of inner shell, inner shells, or multiple inner shells as discussed herein. Likewise, apertures of the one or more inner shells disposed at least partially within the outer shell 610 may include any embodiments of apertures of one or more inner shells as discussed herein.

Figure 7C:
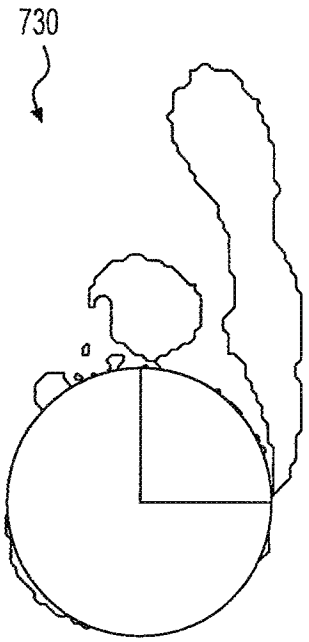
FIGS. 7A-C provide front views of configurations of one or more inner shells and corresponding aerodynamic bleeds, in accordance with some embodiments of the present disclosure.
Figure 7B:
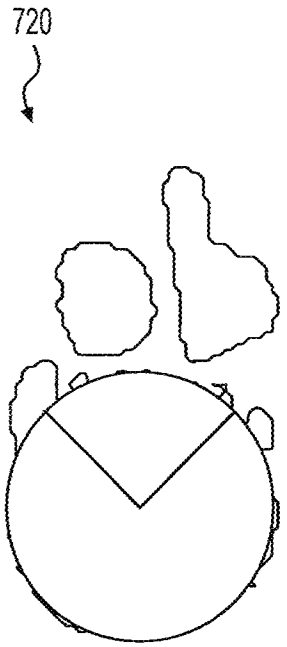
Figure 7A:
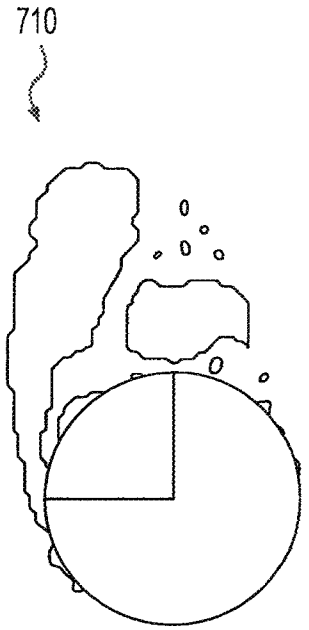

FIGS. 7A-C include illustrations of effects on aerodynamic flow about an aerostructure due at least in part to altering aerodynamic bleed of the aerostructure. Each of FIGS. 7A-C illustrate a configuration of one or more inner shells disposed at least partially within an outer shell of the aerostructure, and a corresponding outlines of vortices induced when the aerostructure is put in motion. As shown in FIG. 7A, a configuration 710 can include a biased vortex, such that the biased vortex indicates a larger vortex on a side of the aerostructure than an opposing side of the aerostructure. That is, the configuration 710 can be characterized by having the biased vortex substantially on a same side of the aerostructure as an aperture of the one or more inner shells, as shown in FIG. 7A. Likewise, as shown in FIG. 7C, a configuration 730 can include the biased vortex on another side of the aerostructure. In this way, axial rotation of the one or more inner shells can be configured to alter the side of the aerostructure experiencing the biased vortex. That is, an azimuthal location of the aperture of the one or more inner shells can be altered based at least in part on a desired location of the biased vortex. As shown in FIG. 7B, a configuration 720 can include a uniform vortex. The uniform vortex, as is understood by those skilled in the art, can be characterized by having negligible side forces. As will be discussed further herein, the configuration 720 can be used at least in part to steer the aerostructure. The configuration 720, in some embodiments, can be achieved in order to nullify side forces and yawing moments acting on the aerostructure. As will be discussed in greater detail herein, the biased vortex can be accompanied by a side force. Further, the side force can be configured to steer the aerostructure. In this way, the aerostructure can be configured to be steered based at least in part on axially rotating the one or more inner shells. Further, the aerostructure can be configured to be steered based at least in part on the azimuthal location of the aperture of the one or more inner shells. Thus, in some embodiments, the aerostructure can be configured to be steered based at least in part on altering the aerodynamic bleed through at least a portion of apertures of the outer shell of the aerostructure.

As can be understood by those skilled in the art, altering aerodynamic bleed of an aerostructure may be configured to steer the aerostructure. In this way, axially rotating one or more inner shells within an outer shell of the aerostructure may be configured to steer the aerostructure.

Figure 8:
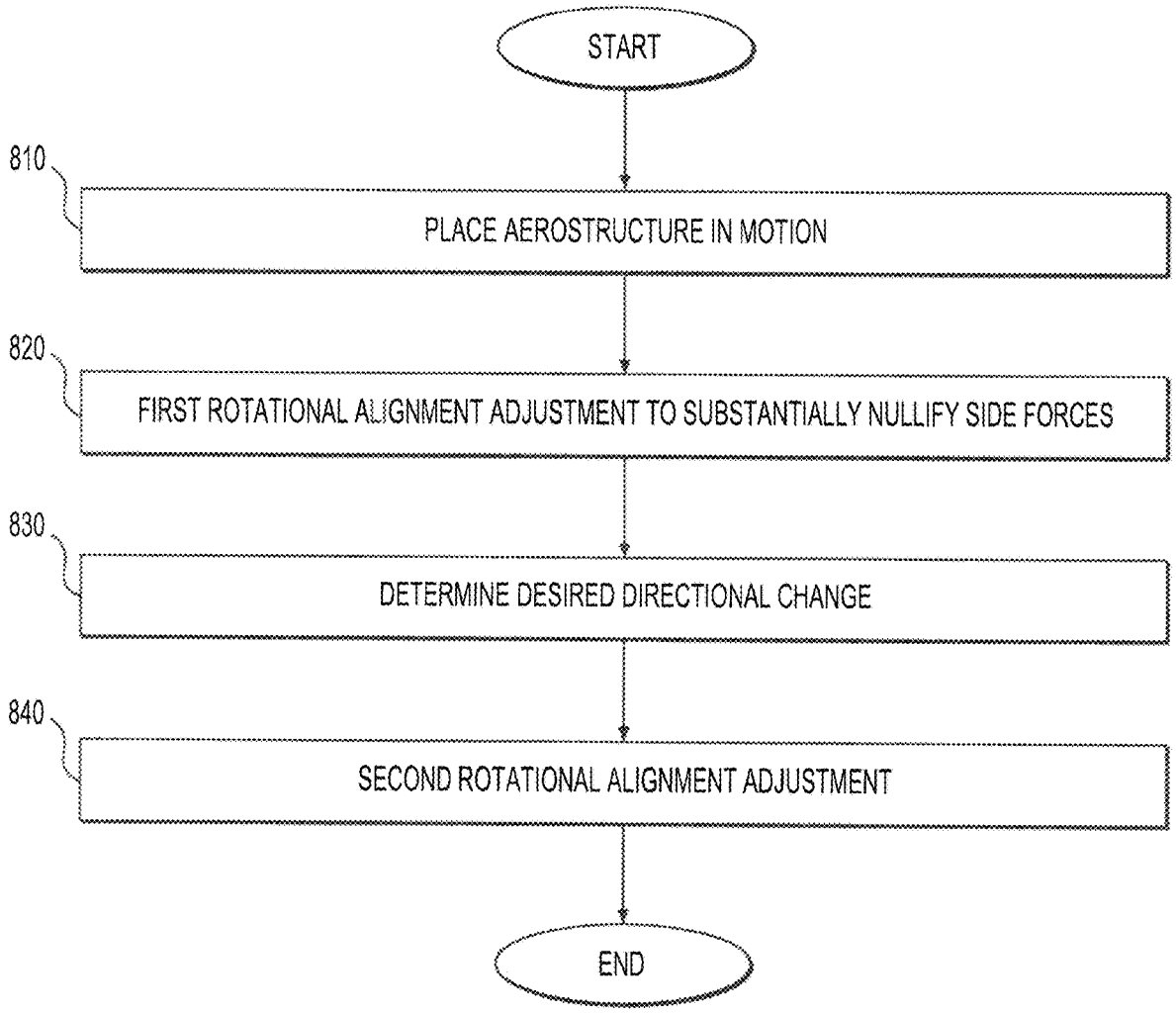
FIG. 8 provides an example block diagram for a method of steering an aerostructure via altering aerodynamic bleed, in accordance with some embodiments of the present disclosure.

FIG. 8 illustrates an example method for steering an aerostructure based at least in part on altering aerodynamic bleed of the aerostructure. The aerostructure, in some embodiments, can be the aerostructure 200 discussed herein. That is, the aerostructure can include the system 100. The method can include placing 810 an aerostructure in motion. The aerostructure can include any embodiments of aerostructures discussed herein. In motion, in some embodiments, can include relative motion, as in air flowing over the aerostructure with respect to the aerostructure. That is, the aerostructure being in motion can be characterized as the aerostructure having a substantial fluid flow over the aerostructure. The method can further include making 820 a first rotational alignment adjustment to substantially nullify side forces and yawing moments. The first rotational alignment adjustment, as discussed herein, can refer to the rotational alignment of the outer shell and the inner shell. In some embodiments, the actuator 132 can make the first rotational alignment adjustment. Further, the actuator 132 can make the first rotational alignment adjustment via axially rotating one or more inner shells of the aerostructure with respect to the outer shell. As will be appreciated, substantially nullifying side forces and yawing moments can improve aerodynamic performance of the aerostructure. The method can further include determining 830 a desired directional change. The desired directional change can be in any navigational direction as understood in the art. Specifically, within the context of aerostructures, the desired directional change can be of any degree within the pitch, roll, and yaw directions, as understood in the art. Specifically, the desired directional change can be selected based at least in part on the embodiments of outer shell and one or more inner shells selected for the aerostructure. In some embodiments, the desired directional change can be determined via a user, or pilot, such that the user can manually steer the aerostructure. In some embodiments, the directional change can be determined automatically by a control system, computer program, machine learning model, or similar mechanisms known in the art. In this way, temporal steering adjustments can be made to the aerostructure utilizing the present disclosure based at least in part on the desired directional change. The method can further include making 840 a second rotational alignment adjustment. As discussed herein, the second rotational alignment adjustment can include altering the rotational alignment of the outer shell and the inner shell. That is, the second rotational alignment adjustment can include altering aerodynamic bleed of the aerostructure. The second rotational alignment adjustment, in some embodiments, can include an induction of vortices on a side of the aerostructure. The vortices, in some embodiments, can be the biased vortex as discussed herein. That is, the second rotational alignment adjustment can include inducing side forces on the aerostructure. The induction of side forces, as can be appreciated, can further include steering the aerostructure based at least in part on altering aerodynamic bleed about the aerostructure. As can be appreciated, altering aerodynamic bleed can include axially rotating one or more inner shells of the aerostructure with respect to an outer shell of the aerostructure. In this way, the actuator 132 can be configured to control the rotational alignment of the inner shell 120 and the outer shell 110 based at least in part on a side force component from a fluid flow on the aerostructure. Further, the actuator 132 can be configured to cause the inner shell 120 to transition between the first rotational alignment with the outer shell in which the inner shell 120 blocks aerodynamic bleed through at least a portion of at least one aperture of the outer shell 110 and the second rotational alignment with the outer shell in which the inner shell allows aerodynamic bleed through the at least a portion of the at least one aperture of the outer shell 110.

EXAMPLES

The following sections illustrate example implementations of the present disclosure.

Technical Background

Investigations of the aerodynamic characteristics of axisymmetric slender bodies at moderate and high incidence angles since the 1950s have been largely motivated by the flight dynamics of missiles, munitions, and fighter aircraft. These flight platforms encounter complex, unsteady aerodynamic loads that are usually far less significant at lower angles of attack and are associated with the appearance and evolution of trains of spatially-and temporally-varying vortical structures over the body and in its near wake. The earlier studies showed that these vortical structures are spearheaded by the formation and asymmetries of counter-rotating vortex pairs near the upstream end of the forebody. The dynamics and asymmetries of these forebody vortices and their interactions with vorticity concentrations within the oblique shear layers that bound each side of the near wake along the main cylinder and its aft segment can contribute to strong unsteady side-and cross-stream forces and yawing and pitching moments that may be used for attitude control.

In one of the early investigations of the forebody vortices, Jorgensen and Perkins (1958) tracked the forebody vortex cores over an inclined ogive-cylinder body (L/D=3, M=1.98). These authors showed that the detachment of the vortices from the surface of the cylinder moves rapidly upstream with increasing inclination angle, and that for a given angle the strength of the vortices increases along their axes apparently indicating merging with the adjacent azimuthal vorticity layer along the surface of the cylinder. Nelson and Fleeman (1975) attributed the induced changes in side force and yawing moment on the cylinder to asymmetric shedding of vortices from its leeward side. Yanta and Wardlaw (1977) noted the asymmetry of the forebody vortices and flow at high inclination angles can be caused by minor variations of the nominally axisymmetric forebody, and in a subsequent investigation (Yanta and Wardlaw, 1981) attributed the side force that occurs when one of the forebody vortices detaches from the body to the opposite sense vortex that remains attached. Subsequently, these authors found that the asymmetric vortex pattern ($\alpha$=45°) is formed as a result of secondary vortices that develop adjacent to the primary forebody vortices, causing one of the primary vortices to become detached from the surface (Yanta and Wardlaw 1982; Wardlaw and Yanta 1982). In an investigation of Re effects on the flow over an ogive-cylinder ($0.2.10^6<Re_D<4.10^6$, $20°<\alpha<90°$) Lamont (1982) noted that while large side forces due to asymmetric vortex shedding were present during laminar and turbulent leeward surface separation, force diminution during transition was attributed to separation asymmetries owing to different transitional states on opposite sides of the body.

The details of the forebody geometry strongly affect the aerodynamic loads induced by asymmetric vortex shedding. For example, for ogive cylinder bodies the asymmetric side force increases with the fineness ratio (Pick 1972; Jorgensen and Nelson 1974; Keener and Chapman 1974; Dahlem et al., 1980). Furthermore, Keener and Chapman (1974) reported that for a given forebody fineness ratio the side force first decreases and then increases with increasing the tip bluntness (ratio of tip radius to body radius) and for some tip bluntness can result in almost negligible side force (at M=0.25) past which the side force increases along with significant flow unsteadiness. More recently, Kumar et al. (2005) assessed the effect tip bluntness of inclined slender cones on vortex asymmetry and showed that the vortices tend to become more symmetric as bluntness increased and the resulting side forces on the model tend to decrease. The sensitivity to the shape of the forebody shape was also investigated for ogive and elliptical forebodies by Luo et al. (1998) and for hemispheric, elliptic and ogive forebodies by Sirangu and Ng (2010) who reported that the ogive bodies produced the least vortex asymmetry and side forces. In a recent experimental investigation of the vortex asymmetry on a conical forebody, Taligoski et al. (2014) showed that the bi-stable side-force and moment characteristics with varying roll angle at high angles of inclination resulted from the formation of a stronger vortex that was advected away from the surface and its initiation was attributed to micro-scale surface imperfections close to the forebody tip.

Based on simulations and flow visualization studies of the forebody vortex flow over a range of angles of inclination in various studies (e.g., Wu et al., 1986, Ward and Katz 1989a, 1989b, 1989c, Zilliac et al. 1991, and Deng et al. 2003), the topology of the forebody vortices over a range of inclination angles can be divided into three primary regimes. These regimes include: symmetric vortices that are mostly jointly located adjacent to the surface of the cylinder or become jointly detached from the surface ($\alpha$<30°), asymmetric vortices where one of the counter-rotating vortices become detached first, leading to mutual roll (30<$\alpha$<60°) and to significant side force and yawing moment, and unsteady wake-like flow when the vortices couple to the oblique shear layer and Kármán shedding off the cylinder section (60<$\alpha$<90°).

In an effort to mitigate asymmetric vortex formation and the associated increase in side forces and yawing moments, Rao (1979) used helical trips to modify the forebody surface of an axisymmetric cylinder (L/D=6-9, $\alpha$<55°) and showed that induced nonuniform separation over the forebody disrupted the coherence of the shed streamwise vortices. Similarly, Modi et al. (1984) showed that passive modifications (including surface grit and helical trips) on conical forebodies led to reduction of up to 60% in the side forces. Further improvements were achieved by adding a rotating tip and a nose boom, resulting in a remarkable reduction of 98% in side force at $\alpha$=30°, presumably due to complete suppression of the vortex pair. The utility of movable and/or deployable mechanical protrusions for reduction in aerodynamic side forces and moments has also been investigated. Rao et al. (1987) tested deployable strakes on an isolated forebody (L/D≈5; $\alpha$=50°) and reported large changes in the side forces with the strakes azimuthal angle that were associated with the formation of a 'strake vortex' that remained close to the forebody, or a larger-scale detached 'spoiler vortex'. Leu et al. (2005) utilized an array of inflatable micro-balloon actuators fixed to the surface of a conical forebody (L/D=5) to induce the formation of asymmetric vortices and side forces of a desired direction. Stucke (2006) manipulated the forces, pitch and yaw moments, and roll angle of an inclined axisymmetric body (L/D=4, $\alpha$=50°) using spoilers and strakes near the leading edge, and, in a follow-up work, Lopera (2007) used a deployable version of the strake as part of a closed-loop flow control system for maintaining a specified angle of inclination. More recently, Mahadevan et al. (2018) triggered and managed the asymmetry of forebody vortices using boundary layer scale hemispherical protrusions on a highly-polished conical forebody.

A number of investigations employed fluidic actuation (steady and unsteady blowing and suction) and limited plasma actuation near the tip of inclined forebodies to manipulate the shedding of the vortices from the leeward surface and thereby effect changes in the side forces and yawing moments. Steady jets have been used over a range of subsonic and transonic speeds and momentum coefficients (e.g., Peake et al., 1980, cone, L/D=5.7, $\alpha$~20°, $C_\mu$~0.005, Almosnino and Rom, 1981, cone, L/D=6, $\alpha$=35°-55°, $C_\mu$<0.002, and Skow et al., 1982, ogive, L/D=3.5, $\alpha$=35°-55°). More recently, Kumar et al. (2008) used a jet blowing upstream along the axis of and through the tip of an inclined cone to mimic fluidic 'nose blunting' and reported a reduction of up to 80% in side forces at $\alpha$<45°. Unsteady blowing using a linear array of synthetic jets along the leeward stagnation line of a conical forebody was used by Williams et al. (1989) and Williams and Papazian (1991) to form "pneumatic" splitter plate and effect flow symmetry at $\alpha$=55°. In a related investigation, Williams and Bernhardt (1990) used synthetic jets for variable control of the forebody vortices and of the sectional side force at $\alpha$<50°. Similarly, Kalyankar et al. (2018) used unsteady sweeping jets on the side of an inclined cylinder (L/D=9, $\alpha$=60°) to alter the separation line on the surface and generate yaw moment as large as $\Delta C_{LN}$~0.8 with $C_\mu$=2.7%. The "phantom yaw" effects associated with asymmetric vortex shedding over a pitching axisymmetric body (L/D=20) were characterized in the recent simulations of Schnepf and Schülein (2018), who used steady blowing from a slot along the side of the body to mimic an "aerostrake" and to mitigate asymmetric vortex shedding and reduce the aerodynamic side force by 25%. In a noteworthy approach, Sato et al. (2016) were able to reduce the side force and yawing moment on a cone-body (L/D=5.7, $\alpha$<90°) by up to 50% by using autonomous bleed driven through internal passages within a forebody cone by the external pressure differences. Plasma actuation was used by Fagley et al. (2012) to manipulate the asymmetric aerodynamic side force on an inclined forebody (Kármán ogive, L/D=3.5, 40°<$\alpha$<60) by up to $\Delta C_y$=±1. Considering the effectiveness of active actuation, a number of investigations have demonstrated closed-loop feedback control of the aerodynamic side forces induced by the forebody vortices. For example, the methodology of Porter et al. (2014) was recently adopted by Seidel et al. (2018) in a simulated closed loop feedback controller which could effect specified side forces.

Experimental Setup and Wind Tunnel Model

The present investigations were conducted in an open-return wind tunnel at Georgia Tech in a square test section measuring 91 cm on the side with a free stream velocity of $U_o$=40 m/s. The axisymmetric model is wire-supported in an open-return wind tunnel (test section measuring 91 cm on the side) by a dynamic 6-DOF eight-wire (1.2 mm dia.) traversing mechanism described in detail by Lambert et al. (2016). Each support wire is controlled by an independent servo motor, with an in-line load cell, and electrical connection for the flow control actuators is provided by thin wires weaved along the back four support wires while the support wires provide electrical ground. The forces and moments on the model are calculated from the measured wire tensions projected onto the model (the resultant aerodynamic loads on the model are calculated relative to the loads in the absence of cross flow, and accounting for wire drag). The attitude of the model is commanded by a Matlab Simulink controller, which feedback utilizes inputs from VICON motion-capture camera system at an update rate of 500 Hz. Besides providing the feedback signal, the six-camera motion capture system resolves the spatial and temporal position of the model at any instant in time. In an alternate configuration, the feedback loop can be disconnected and the model 'locked' in the desired attitude. Either configuration is utilized, depending on the objectives of the studies.

The information regarding the model position/orientation is used to extract the wire orientation and accurately decompose the forces measured on each load cell into x, y, and z components in real time.

Two different slender axisymmetric models were utilized in the present studies. Initially, flow control efforts were centered about the synthetic jet control of the model aerodynamic loads, having the model diameter D=40 mm and L/D=11, including the tangent ogive forebody of the length l/D=2. Since the prior studies indicated that the ogive body geometry generally induces more prominent side forces when compared to the conical forebodies (e.g., Chapman et al, 1976), the ogive geometry is utilized in the present investigation. The investigations were focused on control of autonomously-formed forebody vortices over a range of angles of inclination (25°°<$\alpha$<65°), while the wind tunnel was operated with uniform wind speed of $U_o$=30 m/s, while the emphasis is placed on the high angle range 45°°<$\alpha$<65°.

The axisymmetric body is comprised of three major modules: the ogive forebody, synthetic jet actuator module, and the central cylindrical body. Both the forebody and the jet module are designed such that can be rotated by the full azimuthal period. The azimuthal orientation of the forebody $\phi$ and the jet $\theta$ are referenced to the top vertical point, with the angles increasing clockwise, in the upstream view. The jet module incorporates a single azimuthal orifice measuring 0.6×15.7 mm, imparting the jet momentum coefficient $C_\mu$ while issuing normal to the surface at the frequency of about 2.3 kHz. To illustrate the forebody vortices that the control jet is designed to affect, the forebody vortex pair is visualized over the default l/D=2 ogive forebody at the angle of attack $\alpha$=60°. For that purpose, a mixture of a titanium-oxide paint and the linseed oil is applied over the forebody, where its ratio is iteratively adjusted such that the oil mixture does not shear before the operating flow condition is attained. After the test section speed reached $U_o$=30 m/s, the oil is sheared for about 20 minutes. The two vortical traces are clearly seen, forming off the forebody tip and evolving along the forebody surface. The strong traces along each line where the vortex lifts the flow away from the surface indicates that these vortices remain in the proximity of the surface over the full forebody extent.

The second set of experimental studies was focused on the aerodynamic bleed control of slender axisymmetric bodies at high angles of attack, and this model had a cylindrical body (diameter D=50 mm, length L=7 D) with a tangent 2 D long ogive forebody that can be rotated azimuthally, resulting in the overall L/D=9. These investigations focused on aerodynamic-bleed control of the forebody vortices that form autonomously over a range of angles of incidence (35°<$\alpha$<55°) at cross stream speeds of up to $U_o$=30 m/s ($Re_D$=9.9·10$^4$).

In addition to measurements of the aerodynamic loads, characteristic flow fields about the models were measured by the particle image velocimetry (PIV) techniques. A stereo PIV (SPIV) system is used to characterize the 40 mm dia. model's wake dynamics using two CCD cameras that are each placed at an angle of 20° relative to an image plane normal to the oncoming flow at x/D=2-9 from the tip of the model. Initial PIV measurements of the 50 mm dia. model focused on the vortex-dominant, wake side of the flow about the body, and this PIV configuration. A planar PIV system is used to characterize the model's forebody vortices and wake dynamics using a CCD camera aligned with the model axis of the model and placed downstream of the aft end of the model, imaging 532 nm Nd:YAG laser sheet such that the measurement plane is normal to the model's axis at several axial stations. Such PIV orientation enables investigations of the near-surface flow and the advection of streamwise vorticity concentrations into the near wake. Taligoski et al. (2015) demonstrated that, with a similar optical setup, it was possible to capture cross flow velocity field near the surface of the model. In the present investigations, 1,000 instantaneous PIV images are acquired at 1 kHz at x'/D=1.6, 2.2, 4.0, 6.0, and 8.4 from the tip of the model's forebody at inclination of $\alpha$=50°. Schematics also illustrate orientations of the six motion-capture cameras that are distributed evenly on both sides of the test section. Final, detailed PIV investigation of the flow about the slender axisymmetric body at high angles of attack is designed such that the measurements can be done over both the windward and leeward sides of the body's cross-section. For that purpose, the laser-sheet optical paths were assembled on either side of the wind tunnel test section. Laser beam is initially directed to a linear traverse on the top of the test section carrying two 45° mirrors; one mirror directs the beam to the front and the other to the back of the test section. Both sides of the wind tunnel have identical optical paths that first direct the beam to another mirror atop the vertical rail attached to the computer-controlled traverse. After being directed downward and passing through a spherical and cylindrical lens, the laser sheet is finally directed horizontally intersecting the model's cross section and illuminating either the windward or leeward side of the flow about the model. Each PIV camera is mounted on its own linear traverse, aligned with the model axis. All the PIV measurements are done in the following procedure. The PIV camera is positioned at the starting distance from the model, at the focal length of the first measurement plane. Then, the laser beam is steered to the front forming the illuminated sheet on the vortex pair side. Once the PIV measurements are taken on this side, the laser beam is then steered to the back by the second mirror on the top and the paired PIV measurements are taken on the flow stagnation-point side of the model. Once such a pair of measurements is taken, both the laser sheet (still directed from the back) and the PIV camera are axially incremented to the next plane, and the first set of PIV measurements are taken. Next, its complementary PIV measurements on the vortices'side are taken after the top mirrors are switched again. Clearly, this procedure is thereafter repeated until the last measurement plane.

The Base Flow

Initially, the aerodynamic loads on the cylindrical model were characterized in the absence of actuation over a range of inclination angles (25°<$\alpha$<65°, $Re_D$=7.9·10$^4$) using the three ogive forebodies of l/D=1, 2, and 3. The inclination angle of each model was increased monotonically from the same base angle to avoid hysteresis effects. In order to enable meaningful comparison between the models with the different ogive forebodies, the variation of the force coefficients $C_D$, $C_L$, and $C_S$ were computed based on the model's planform area (including the forebody). Hoerner and Borst (1985) characterized the lift and drag on an inclined cylinder in the absence of a forebody. These authors noted that at low inclination ($\alpha$≤15°), the flow over the cylinder is predominantly oriented along its axis and it may be thought of as low-aspect-ratio wing with a pair of counterrotating "tip" vortices that form over the suction surface resulting in lift-induced drag. At higher angles of attack, the flow from the windward to the leeward face of the cylinder separates on its leeward face and generates a normal force on the body whose respective cross-stream and streamwise projections are the lift and drag. Both lift and drag forces are small for $\alpha$≤15°, and as a increases, the drag increases monotonically and reaches a maximum at $\alpha$=90°, while the lift has a local maximum (around 55°), and then decreases monotonically and vanishes $\alpha$=90°.

On the present model, the drag increases monotonically over the entire range of a while the rate of increase of the lift begins to diminish for $\alpha$>35° ostensibly as the forebody vortices begin to lift off the cylinder and the flow from the windward separates on its leeward surface. Similar to the observations of Hoerner and Borst (1985), while the drag force continues to increase monotonically, the lift force has a maximum around $\alpha$=55°, and then decreases at higher angles of incidence. While the drag coefficients for the three ogive forebodies are nearly identical through $\alpha$~60° the drag coefficient of the l/D=3 ogive is lower at higher a and appears to reach a local maximum that is lower than the corresponding drag coefficients of the l/D=1 and 2 ogives. However, the corresponding peak lift coefficients of the l/D=1 ogive is lower than the coefficients of the other ogives. It is apparent that these changes are associated the changes in the side forces that remain nominally symmetric about the cylinder's vertical (y-z) plane of symmetry up to $\alpha$~50°. According to earlier work (e.g., Keener and Chapman, 1974), the onset of the vortex asymmetry approximately scales with the forebody tip angle, which is 58° for the present model. As is evident from the variations of the side force coefficients, the onset of forebody vortex asymmetry which is affected by small variations in the ogive surfaces, varies between the different forebody models, and also affects both the lift and drag forces. For the remainder of the current study, the forebody is fixed at l/D=2. In addition, it is observed during the pitch sweeps that the model, once in the non-zero side force domain, can undergo unstable motion.

To gain a better understanding of the base flow features at high angles of attack, preliminary sPIV measurements are taken at three streamwise positions, measured from the forebody tip, x/D=2, 5, and 9 while the body is oriented at $\alpha$=60°. These locations are selected such to characterize the flow state just downstream from the location of the control jet, far over the body, and finally off the body, in the wake. Due to the wake spreading, the measurement resolution is adjusted with the downstream distance, such to capture the wake extent. For the same reason, measurement s on the wake are taken over two measurement planes that are merged into a single composite flow field. The resulting captured flow field can illustrate the dominant vortical composition of the flow. As it could be expected, the initial vortex pair, formed at the forebody, lifts off the surface shortly downstream from the forebody, due to the high incidence. Although still at the surface at x/D=2, this pair evolves into a highly asymmetric pair at x/D=5, where the CW vortex remains closer to the body, while the CCW vortex, rotated in pair with the CW one, moves away and nearly atop its CW pair. This relative orientation remains preserved into the wake at x/D=9. Once the initial vortex pair is peeled off, the successive folding of the flow over the cylindrical body results in the secondary vortex pair formation, which is just barely captured at the bottom end of the measurement plane at x/D=5, and fully seen at x/D=9 underneath the primary vortex pair, and assuming a nearly identical relative orientation between the CW and CCW vortices. Besides these two pairs of streamwise vortices, additional vortical concentrations are seen in the wake, as it is expected that the shear layers of the flow separating of the cylinder body partially contribute to the streamwise vortical components. Besides, each vortex can induce a neighboring lesser vortical motion of the opposite sense, which is likely manifested just below the lowest CW vortex at x/D=9.

The uneven liftoff of the vortex pair and its subsequent tilt about the common axis signalizes disruption in the side force balance and induces a net non-zero side force. Such a liftoff of one of the forebody vortices from the surface was documented in detail in a number of earlier studies. Lamont and Kennaugh (1989) showed a nearly periodic switching in the direction of the side force as the forebody is rotated azimuthally about the axis of the cylinder over a range of incidence angles, which reflects the switching vortex asymmetry in the flow. As shown by Mahadeven et al. (2018) even fine polishing of the forebody surface was insufficient to fully suppress the vortex asymmetry and the direction switch of the induced side force. It should be noted that this sensitivity of the forebody vortices to small perturbations indicates their potential receptivity to flow control actuation as well.

The asymmetry in the evolution of the forebody vortices and the resulting side forces is investigated at $\alpha=60°$ ($Re_D=7.9\cdot10^4$) over a full azimuthal rotation of the l/D=2 forebody. The resulting drag, lift, and side force coefficients (each normalized by the cylinder's cross sectional area Ab). In concert with the earlier investigations, the side force exhibits azimuthally-periodic switching. However, $C_S>0$ for most of the azimuthal orientations $100°<\theta<220°$, $275°<\theta<50°$ and switches direction $C_S<0$ only within narrow azimuthal domain centered about $\theta=70°$ and 220°. One notable exception is a sudden drop of the side force at $\theta=330°$, which is caused by the body undergoing instability for that particular forebody orientation. It is interesting to note that the induced side force does not change its direction when the forebody is rotated at 180° relative to some given azimuthal position (i.e., $C_s>0$ or <0 at both domains although the nominal magnitudes of the opposite side forces are not necessarily of the same). That the sense of the side forces does not change when the forebody is rotated at 180° indicates that the flow asymmetry is likely not brought about by a random surface imperfection, because a strong periodic behavior of the present data (and a number of the earlier studies) suggest that the origin of such behavior is likely in the regular geometry deviation with a preferential axis. The most obvious source of such deviation would be an imperfect tip of the forebody, particularly since many investigations indicated extreme flow sensitivity to small geometrical perturbations at the forebody tip. Examination of the tip of the current forebody model indicated small oval deviation from the perfectly circular termination of the tip, and it is argued that such an oval shape with the dominant axis would be sufficient to induce preferential vortex asymmetry, depending on the dominant axis azimuthal orientation. Moreover, as the forebody is rotated by 180°, the oval orientation would assume the same orientation of its dominant axis, which would explain periodicity is the side force formation. As the oval manufacturing perturbation is not perfect, this would also explain that asymmetry in the magnitudes of the excursions and the disparity in their azimuthal extents are associated with the randomness of this deviation. It is remarkable that for fixed angles of incidence and yaw the lift and the drag are nearly invariant with q$ even though the side force undergoes significant variations which are associated with topological changes in the trajectories of the streamwise forebody vortices. This indicates that once the vortices separate and migrate off the cylindrical body, their effects on the lift and drag diminish.

The changes in the topology of the vortex pair associated with the changes in the direction and magnitude of the side force can be illustrated in color raster plots of the time-averaged streamwise vorticity superposed with vectors of the cross-stream velocity field captured using stereo PIV within the domain $-6<y/R<6$, $-6.5<z/R<6.5$ (x/D=9) for $\theta=90°$ and 180°. The data shows a dominant pair of counter-rotating streamwise vortices where the CW vortices in this view are associated with the rollup at the left side of the forebody (in this upstream view), along with additional, weaker streamwise vortices that would be shed within the cylinder's wake (cf. the simulations of DeSpirito 2017). As is evident from the vorticity concentrations, the major axis of the dominant vortex pair (i.e., the axis centered between the vortices, nominally normal to a line through the centers of their cores and pointing in the direction of the induced flow) can be rotated by 128° (from 26° to 154°). The directions of the major axes are asymmetric (i.e., the major axes can be pointing to the right and the left, respectively) and commensurate with the changes in the directions of the side forces namely Cs<0 at $\theta=90°$ and $C_s>0$ at $\theta=180°$. It is also noteworthy that the change in the directions of the major axes of the primary vortex pair is also accompanied by changes in the sense of the accompanying streamwise vortical traces that are captured within the field of view, ostensibly by reversal of the induced cross flow by the dominant vortex pair.

To summarize the base flow topology over the slender axisymmetric model at high angle of attack, the color raster plots of the streamwise vorticity relative to the body coordinate system (x') at five cross stream planes along the model for the pitch angle $\alpha=50°$. The initial formation of the forebody vortex pair at x/D=1.6 is reasonably symmetric and has nearly identical magnitudes of the vortex circulations. The symmetry appears to be preserved at x'/D=2.2, where only the entrainment-driven growth of the vortices is measured. Some disruption in symmetry is noted at x'/D=4, where both vortices begin to deflect away from the surface. By x/D=6, the two forebody vortices appear to have been displaced away from the surface and their streamwise vorticity is weakened as a result of spreading, while the CW and CCW vortex sheets on both sides of the body's wake begin to roll up underneath the primary vortex pair. The asymmetry in the shedding of the forebody, as is evidenced by their trajectories, is manifested by an induced net right side force (along y'<0) as a result of the earlier displacement of the CW vortex. The topology of the streamwise vorticity at x'/D=8.4 indicates that the asymmetry propagates downstream, as the CW is seen displaced further into the wake than its corresponding CCW pair. Furthermore, formation of the secondary vortex pair about the cylindrical body continues underneath the displaced primary vortex pair, and their asymmetry further contributes to the net side force.

The Controlled Flow

Azimuthal Control of the Forebody Flow Using Segmented Forebody Aerodynamic Bleed The prior studies that indicated the sensitivity of the evolution the forebody vortex pair to small surface perturbations also pointed out to a path of exploiting this sensitivity for controlling the aerodynamic loads with minimal control input. An approach to delay the side force, relevant to the present study, was tested on a forebody model by progressively perforating the increasing axial extent of the forebody and utilizing the aerodynamic bleed driven by pressure differences to enforce flow symmetry (Bauer and Hemsch, 1994). They showed that the increase in incidence of the onset of a nonzero side force was proportional to the axial extent of the bleed. In a similar application, Fears (1995) reported comparable results when replacing the solid forebody of a fighter aircraft model with a porous forebody as an alternative to control by strakes for generating yawing moment.

The present investigation is motivated by the findings of Bauer and Hemsch (1994) and focuses on exploiting segmented porosity over the forebody of a cylindrical platform for suppression of asymmetric baseline side forces that arise from flow sensitivity to minor imperfections of the body surface. Furthermore, configurations of segmented bleed actuation are also used for prescribing desired side forces and yawing moment for bi-directional aerodynamic control.

The axisymmetric body is comprised of three major modules: The ogive forebody, the central cylindrical body, and the aft control module, which is kept inactive in the current investigation. The prior work (Lee et al. 2021a and 2021b) focused on direct control of the separating flow on the leeward side of the body, which, in turn, altered the dominant wake vortical composition through its inherent coupling. During the present investigation, the aerodynamic loads on the model are controlled by manipulation of the symmetry of the forebody vortices and, consequently, their interactions with the cylinder's wake using the aerodynamic bleed over the forebody. Therefore, while the earlier approach affected the dominant streamwise vortices, and consequently the aerodynamic loads, indirectly by focusing on their coupling to the wake along the cylindrical body, the present investigations focus on the direct control of the forebody vortices over their formation domain along the forebody. For that purpose, instead of the forebody with integrated fluidic actuation, a forebody with azimuthally distributed bleed ports is designed and manufactured, following the forebody bleed study of Bauer and Hemsch (1994). Initially, three different azimuthal extents of the bleed surface over the forebody are tested, spanning 45°, 90°, and 180° azimuth of the forebody. Each of these three configurations is tested in two orientations relative to the flow, by promoting the flow symmetry in the top-central orientation of each segment, and by promoting the flow asymmetry by orienting each segment to be centered on one side of the body. These preliminary results indicate that base flow suppression of asymmetry, expressed through the lowering of the resulting side force, increases with the azimuthal opening on the top of the forebody. In contrast with this, a minimal effect on the asymmetry is measured, as all the three configurations exerted nearly the same magnitude of the side force. Based on these preliminary findings, in spite of slightly better results achieved by half-the-circumference bleed application, it is decided to conduct a full investigation by utilizing a 90° bleed opening due to the limited number of orientations that the 180° bleed section would allow.

The bleed forebody model can comprising the outer and inner shell. Each azimuthal half of the outer shell is populated by the ten bleed rows, having the equal angular distribution, while each row comprises seven streamwise narrow bleed slots. Different bleed configurations are formed by closing inactive ports, where the closed ports can be seen in light color. Given the primary targeting of the two forebody vortices with an objective of both symmetric and asymmetric alterations of that vortex pair, a total of eight different bleed configurations are tested. Dark azimuthal sections represent the active bleed segments, where most configurations represent different azimuthal orientations of the 90° bleed segment, except for a configuration having fully open bleed ports across the whole forebody surface. Therefore, the tested configurations, from left to right, included the fully closed (i.e., the base flow) and fully open configurations, top right, top and bottom left 90° segments, and the 90° segments centered at the left, top, and bottom.

The present work particularly focuses on the forebody vortex pair evolution over the body, while the prior work (Lee et al., 2021a and 2021b) placed emphasis on the wake interactions of these vortices, both in the presence and absence of flow control. To illustrate the base flow over the model with all the bleed ports closed, the color raster plots of the streamwise vorticity relative to the body coordinate system (x') at five cross stream planes along the model for the pitch angle $\alpha=50°$. The initial formation of the forebody vortex pair at $x'/D=1.6$ is reasonably symmetric and vortices have nearly identical magnitudes of vorticity (and its integral measure of circulation). The symmetry appears to be still preserved at $x'/D=2.2$, where only the entrainment-driven growth of the vortices is measured. Some disruption in symmetry is noted at $x'/D=4$, where both vortices begin to deflect away from the surface. By $x'/D=6$, the two forebody vortices appear to have been grown away from the surface while still remaining attached to it, while the CW and CCW vortex sheets on both sides of the body's surface begin to roll up underneath the primary vortex pair. The asymmetry in the shedding of the forebody vortices downstream from $x'/D=6$, as is evidenced by their trajectories, is manifested by an induced net right side force (along $y'<0$) as a result of the earlier displacement of the CW vortex. The topology of the streamwise vorticity at $x'/D=8.4$ indicates that the asymmetry propagates downstream, as the CW is seen displaced further into the wake than its corresponding CCW pair. Furthermore, formation of the secondary vortex pair about the cylindrical body continues underneath the displaced primary vortex pair, and their asymmetry further contributes to the net side force.

As the first PIV measurement plane ($x'/D=1.6$) is set right at the axial termination of the bleed, the corresponding flow fields are utilized for an initial assessment of the flow control effects for the fixed pitch angle $\alpha=50°$. Hence, all eight flow fields, corresponding to the eight bleed configurations can be shown in terms of the mean velocity field in the y'-z' plane. The base flow, in the absence of bleed. The overall flow symmetry is emphasized by the symmetric vortices of nearly matched circulation magnitudes. This base flow is first contrasted with the case when the aerodynamic bleed is fully opened across all of the bleed ports. As it could be expected, the net bleed is driven from the pressure side of the surface along the bottom to the upper surface, having a rather dramatic effect on the vortex pair evolution. Consequently, the vortex cores are displaced away from the surface and weakened. It is interesting that they still preserve the symmetry and remain "attached" to the body through the folding vortex sheet off the lower section of the forebody. The localized bleed segments that target only one of the forebody vortices induce asymmetric vortical composition already in the first measurement plane. For instance, symmetrically switched bleed configurations at the top right and left side promote displacement of the vortex on that side, already inducing the vortex/side force imbalance over the forebody. Although not as pronounced as when the bleed segment is directly underneath the evolving vortex on the top left side, even in the case when the bleed segment is along the pressure side, the aerodynamic bleed induces imbalance in the vortex pair growth, by promoting the same-side vortex.

Knowing the outcomes of the aerodynamic bleed across the top and bottom left segments, it is not surprising that by orienting the bleed segment such that half is in the upper and the other half in the lower hemisphere on the left, the primary effect on the growth of the same-side vortex is approximately between the effects of the individual top and bottom segments—the bleed enhances the growth (and asymmetry) of that side vortex, but not as significantly as in the case of the top-segment flow manipulation. In a summary of the three same-side azimuthal orientations of the 90° bleed segment, it appears that the most effective approach in inducing the vortex pair asymmetry is the bleed manipulation directly underneath the evolution of the targeted vortex. Lastly, two additional bleed configurations targeting symmetrically both the left and right forebody vortices are done by centering the 90° bleed segment directly and the top and bottom. Not surprisingly, symmetric application of bleed preserves the overall flow symmetry in both cases. It is interesting that in either case there is actually a very little change even in the vortex structure, where at most the vortex sheet along the surface becomes somewhat enhanced in the case of the top centering, while there is no discernable difference relative to the base flow when the bleed segment is centered at the bottom, symmetrically along the pressure surface.

The resulting global effect of these different bleed configurations is assessed through a cumulative, net change of the aerodynamic forces and moments, which can be shown with respect to the fixed coordinate system (x,y,z,), where x-axis is aligned with the flow direction. As expected, the bleed-induced alteration of the vortex symmetry, which couples to the wake asymmetry, is reflected in the strongest effect on the side force coefficient $C_S$. Cumulative asymmetry in the base flow results in the net side force coefficient of nearly $C_S$=1, along with the net baseline lift and drag forces. It should be noted that the normal force relative to the model orientation (Fz') decomposes into the lift (Fz) and drag (Fx) forces shown in terms of the coefficients $C_L$ and $C_D$. As the bleed control is applied over the full circumference of the forebody, there is a clear drop in the net side force, accompanied by the increase in both the drag and lift coefficients $C_D$ and $C_L$, which implies that the lift force normal to the body Fz' increases as well. As suggested by the altered flow field can be seen, premature displacement of the CCW vortex by the bleed from the top right segment would contribute to the net negative side force. Furthermore, there is an additional increase in both $C_D$ and $C_L$, which also implies additional increase in the body-normal Fz' force. In principle, a switch to the top left bleed segment is expected to generate the same and opposite effect from the top right segment. Indeed, there is a sharp switch in the side force to the net positive side, but some imbalance in magnitudes is attributed to the non-zero base flow, which is already 'biased' towards the net positive side force. It is interesting that the bottom-left bleed case is closer to an inverted top-right case in terms of all the three resulting aerodynamic forces. When the left-side bleed segment is azimuthally centered, the net side force remains positive but with a further reduction in magnitude, while the drag and lift forces remain practically unchanged. Finally, while the top-centered bleed segment reverses the net side force sign back to negative, the bottom-centered segment bleed does not effect much difference relative to the base flow. When assessing the bleed control effect on the moments, it can be expected that the major changes seen in the side force $Fr/C_S$ would translate in the corresponding dominant changes in the yaw moment $C_Y$. Indeed, there may be negligible change in pitch $C_M$, while the most pronounced change is in the yaw moment. All the left-centered bleed control tilts the yaw moment to the net negative, while the opposite sense and a similar to the magnitude in pitch is created by the top-right centered bleed control.

Evolution of the flow fields for the two presumably most interesting control cases that provide the opposing net side forces and pitching moments can be examined, where the flow fields in all the five measurement planes can be shown for both the segmented bleed control over the top quarter of the forebody on the right side and on the left side. In addition, the base flow field evolution, having the solid forebody, is included for reference. Besides illustrating how the surface vorticity rolls into two forebody vortices in the base flow, along with the cross section at x'/D=2.2 indicates a nearly perfect symmetry in the initial formation of both vortices. By x'/D=4, vortices mainly grow in size and become displaced away from the surface, also indicating a possible onset of asymmetry. By the next measurement plane, the vortices become notably elongated and lose some coherence—a possible indication of the increased unsteadiness. Finally, it becomes clear at the last measurement plane that the CW vortex separated off the body first, while the CCW vortex lags in the detachment. Another notable feature is that as soon as the primary vortex cores become sufficiently displaced off the surface, the continuing supply of the surface vorticity along the cylindrical body from below rolls into a secondary vortex pair. As suggested by the difference in the net side force magnitudes (of opposing signs), it is expected that the flow field evolution for the top-right and top-left segmented bleed control would not be perfectly antisymmetric. Still, the dominant features are clearly antisymmetric. Right at the axial termination of the bleed control the vortex on the side of the activated bleed grows disproportionally and by x'/D=2.2, it already begins to separate off the surface, while its counterpart's growth appears even inhibited relative to the base flow. The flow fields remain nearly antisymmetric even at the next measurement plane, where the already detached vortices still remain within the measured field of view. It is interesting to note that both counterparts of the detached vortices shift azimuthally along the top surface across the vertical plane of symmetry and affect the initial rollup of the secondary vortices underneath the detached primary ones. By the next measurement plane at x'/D=6, the second primary vortex also becomes detached in either case, while their counterparts are already outside of the measurement field of view. Some discrepancy in the overall anti-symmetry of the flow is seen in the pair of secondary vortex pairs that form along the body surface. However, the main feature of the azimuthal tilt of the remaining surface-bound vortices is seen in either case. As it was observed for the primary vortex detachment, the surface-bound vortex pair tilts azimuthally to the side of preceding vortex detachment. By the last measurement plane, there is another strong switch in the vertical directionality of the wake above the body, having a stark contrast to must a weak disruption in the wake symmetry observed in the corresponding base flow. Aside from the vortical composition of the flow, there is additional interest in assessing the level of the flow unsteadiness, with and without the flow control. For that purpose, the in-plane contribution to the turbulent kinetic energy TKE. Overall, relatively low levels of the velocity fluctuations are measured in the base flow upstream planes, indicating a fairly stable initial rollup of the forebody vortices. While the vortical field at the next plane at x'/D=4 only hinted to the onset of asymmetry, the corresponding TKE field clearly indicates the onset of unsteadiness on the CCW side of the vortex pair. The increasing asymmetry in the TKE field is further seen at the next measurement plane, showing a strong peak on the side of the formation of the secondary CCW vortex. As the CW vortex becomes detached and displaced off the body in the last measurement plane, its TKE signature weakens, compared to its still-attached CCW pair. Furthermore, continuing growth of the secondary CCW vortex indicates its formation coupling to the high unsteadiness. It is interesting to note that the secondary formation of the CW vortex actually lags its CCW pair, but appears to form with increased unsteadiness as well. The notable increase in the secondary vortex pair unsteadiness compared to their primary pair counterparts is attributed to their formation within the wake of the cylinder. As previously noted, anti-symmetry in analysis of the flow fields controlled by either the top right or top left 90° bleed segments, is even further supported by comparing the TKE fields over the first three measurement planes. Not surprisingly, the 'braid' of vorticity that feeds into the vortex on the side of the active bleed segment exhibits the elevated TKE. Past the initial vortex detachment from the surface, the remaining flow evolution becomes greatly affected by the surrounding wake, hence rendering the TKE distribution (just as the whole flow field) not exactly anti-symmetric, although the main features remain anti-symmetric throughout the measured planes. Thus, the first detached vortex remains marked by the elongated 'braid' of increased TKE, while the tilted surface-bound vortex remains fairly stable. The overall unsteadiness seems to increase thereafter, after the second vortex detachment, and in particular for the vortices measured in the farthest downstream plane, which is again attributed to the increasing coupling to the growing wake of the cylindrical body, as the vortices progress downstream.

While the previous section focused on the most efficient flow control configurations for creating a net side force of either direction (and the accompanying yaw moments), the general assessment of the net effects of all eight bleed configurations, points to another configuration that can potentially counter the pre-existing asymmetry in the flow and act to promote the flow symmetry and minimize the resulting net side force. Out of all the testing configurations, the one with the fully azimuthally open bleed over the forebody was the most successful with that respect. Hence, the remaining sections of this paper will focus on the detailed analysis of the representatives of the bleed control configurations that promote the flow symmetry (full azimuthal bleed) and asymmetry (top-right 90° bleed segment), in addition to the base flow, which is used as a reference case.

Since the resulting flow fields pertinent to the base and the top-right bleed segment to contrast the characteristic three configurations here, only the flow fields in the most upstream and downstream planes for the base flow and the bleed control by the full and 90° segmented azimuthal bleed. Analogous to the flow fields, color raster plots of the mean streamwise vorticity overlaid with velocity vectors are shown at x'/D=1.6 and 8.4. Clearly differently-evolving flow fields are seen immediately, in the most upstream plane, among all the three considered configurations. While the promoted asymmetry by the sectional bleed control relative to the base flow was noted earlier, it is seen here that the full azimuthal bleed induces a rather dramatic change in the vortex evolution over the forebody, when compared to either of the other two cases. The full azimuthal bleed prematurely and symmetrically displaces both forebody vortices away from the surface, having the bleed contribution clearly marked by the elongated braids of vorticity connected to the primary vortices. Another important distinction is that the vorticity 'feed' off the surface becomes disrupted, and the primary vortices become weaker, having reduced circulation. The altered topology of the primary vortex pair formation over the forebody is certainly carried through their ultimate detachment, al. It is interesting that at the most downstream measurement plane (x'/D=8.4), despite the significant upstream differences, the base flow vortical composition and that in the presence of full azimuthal bleed become reasonably similar, although the circumferential bleed improves the overall wake symmetry, as seen in comparison of the wake flow fields above the body. The similar vortical composition of these secondary vortex pairs is attributed to the fact that the forebody bleed directly affects only the formation of the primary vortex pair and once this pair is detached, the remnants of the forebody flow control can affect the formation of the secondary vortex pair only through their interaction with the altered wake, which is clearly only a secondary effect compared to the secondary vortex pair rollup around the downstream cylindrical body. Interestingly, when the bleed is intentionally asymmetric (i.e., restricted only to the right segment of the forebody), not only that the CCW vortex on the bleed side becomes displaced away from the surface even over the forebody, but the profound change that this asymmetry induced in the upstream wake propagates all the way to the downstream end of the body. Not only that the formation of the secondary vortex pair does not restore to the process seen in the base flow, but both the vortical composition and the whole wake remains biased, which certainly contributes to the net side force attained in this control case, which is a cumulative effect of the whole flow field along the body.

Initial comparison between the three characteristic flow fields is followed by the more detailed comparisons of the mean velocity distributions along the central vertical plane above the body. Such velocity profiles are extracted for all five measurement planes and for both the mean horizontal Uy' and vertical Uz' velocity components. Distributions of the horizonal velocity components are a good proxy for the flow symmetry assessment. Thus, it is seen in the base flow that the flow remains nearly perfectly symmetric in the first three measurement planes, as the horizontal velocity component remains virtually zero across the full vertical distribution. While both other velocity distributions return to zero at the upper end of the measurement domain, the symmetry disruption is clear towards the surface, where both distributions change signs, indicating a presence of the rotational motion in the mean. In accord with the prior analysis, these profiles indicate that the base flow develops asymmetry only at or after the initial primary vortex detachment. The overall improvement in the flow symmetry is suggested by the corresponding profiles for the full azimuthal bleed control, although there is some disruption of the initial symmetry already at the third measurement plane. Still, both of the most downstream planes appear to have the horizontal velocity excursions suppressed relative to the base flow. Finally, it is not surprising that analogous horizontal velocity profiles for the 90° top-right segment bleed are dramatically different than either of the other two cases. As the flow vortical composition becomes immediately biased, this is also reflected in the velocity distributions that are initially predominantly biased such that the flow is towards the displaced vortex, having a positive horizontal velocity component. The switch in the vortex detachment from the third to the forth, and then again to the fifth plane is reflected in the switch of the horizontal velocity bias in, where the velocity profiles at x'/D=4 and 8.4 are biased to the positive, while the profile at x'/D=6 is biased to the negative horizontal velocity. Just as the central horizontal velocity component is shown to be a good indicator of the flow symmetry, and consequently a good predictor for the generation of the aerodynamic side force, the accompanying vertical velocity distribution suggests how the applied flow control may affect the bulk wake evolution, towards or away from the body. The two clear trends are seen in the vertical velocity profiles of the base flow. First, although the near surface negative velocity points to the prevailing flow component towards the surface, it initially strengthens through the first three planes, and then relaxes. This is attributed to the initial vortex pair strengthening (in circulation) as they continuously 'feed' off the surface vorticity until they begin to displace away from the surface and their contribution to the near surface vertical velocity component begins to weaken. Secondly, as expected, a clear opening of the wake away from the surface is seen in the progressive stretching of the velocity profile with distance, while the velocity sign points to the direction away from the body. As seen in the corresponding profiles for the full azimuthal bleed case, only a minor modification of the vertical velocity profile distributions is attained relative to the base flow case, which suggests that only a secondary modification of the bulk wake is attained by the full azimuthal control. Finally, just as in the case of the comparison of the horizontal velocity component, the vertical velocity distributions for the 90° azimuthal segment bleed is substantially different than in the other two cases. The local extent of the flow towards the surface becomes significantly suppressed in this case over the first two planes, followed by its complete suppression. Furthermore, the velocity sign switch is followed by a swift increase in the vertical velocity component away from the body.

Spanwise extent of the wake above the body is analyzed in, where both the mean horizontal Uy' and vertical Uz' velocity profiles are shown as waterfall plots away from the body for the same three characteristic bleed configurations discussed. All the data are shown at x'/D=2.2, which is the most downstream plane at which the full extent of the wake is captured within the measured field of view. Horizontal velocity component in the base flow indicates a fairly antisymmetric perturbation of this velocity due to the presence of forebody vortices, with the velocity slowly relaxing back to zero only at the outskirts of the measurement domain, as marked by the dashed lines. The corresponding vertical velocity distribution exhibits a typical wake structure that, instead to zero, relaxes back to the in-plane vertical velocity projection of the free stream, away from the center. A narrow domain of the reversed flow, towards the body, is marked by the dashed lines. As the full azimuthal bleed is activated, the spatial evolution of the mean horizontal velocity remains antisymmetric, but having attenuated excursions relative to the base flow. This attenuation also results in earlier relaxation of this velocity back to zero in the spanwise extent. Although the vertical component of the velocity excursions becomes also attenuated, the bleed control also spreads the reversed flow region away from the body in either direction. As it can be expected, the asymmetric application of the segmented bleed (90° segment at the top right), biases the flow fields, which is particularly seen in the horizontal velocity component. It is interesting that the disturbance to the horizontal velocity component is effected on the side opposite to the bleed actuation. While the horizontal velocity relaxes faster on the bleed side (marked by the dashed line), it practically does not fully relax up to the edge of the measurement domain on the opposite side. This can be attributed to the promoted roll-up and tilting of the vortex on the side opposite to the bleed actuation. Finally, in comparison of the vertical velocity component distribution relative to the base flow, it seems that the reversed region of the wake does not significantly change, except of the whole wake vectoring towards the unactuated side, only not as pronounced as it was the case of the horizontal velocity component.

Another characterization of the wake evolution through the five measurement planes is based on evolutions of the wake minimum streamwise velocity Uz' distributions across the wake in the vertical and horizontal directions, for the three characteristics. At the first measurement plane immediately downstream from the forebody, no significant difference is measured among the three considered cases. Besides a slight increase in the recirculating extent of the near wake (, a typical downstream evolution of the wake is reflected in the increasing minimum velocity. In addition, the minimum velocity remains closely aligned with the axis of symmetry for all the three cases, indicating that even in the case of induced vortical asymmetry, no significant side-tilt of the wake is effected. Even in the second measurement plane, only a moderate expansion of the distributions observed in the first plane are noted, with no fundamental changes. By the third plane, the aerodynamic bleed begins to substantially alter the natural wake evolution. In the vertical evolution of the minimum velocity, the full azimuthal bleed expands the reversed flow extent relative to the base flow, while the top-right bleed application reduces it. While the other two configurations still nearly preserve the minimum velocity evolution along the axis of symmetry, the asymmetric bleed control clearly offsets the minimum velocity/wake to the side of the bleed activation as the CCW vortex on that side is already shed off the surface. By the next-to-last measurement plane, vortical asymmetry is developed in all the three configurations, which is reflected in all of the vertical distributions. The sharp sideways deflections of the minimum velocity are related to the effect of the wake by the detached vortices, which is clearly the most pronounced in the most vertically-driven wake of the top-right bleed configuration. The corresponding vertical wake evolution indicates a nearly eliminated reversed flow for the top-right bleed. Finally, by the last measurement plane, the full azimuthal bleed case does indicate the least departure from the minimum velocity alignment with the axis of symmetry, while the top-right bleed case induces the widest shifts from one side to the other due to the strong shed vortices, while the vertical wake evolution of the minimum velocity indicates much stronger wake growth for the top-right case compared to the other two.

In addition to the analysis based on the velocity distributions, an integral analysis of the wake flow fields is also undertaken, primarily with an emphasis on the effects of the flow field structure in the wake on the net side force. To this end, the net horizontal momentum flux and vertical momentum deficit are assessed across a control volume depicted by overlaid dashed lines in each of the flow fields. The evolution of the fluxes is assessed by varying the position of the top edge of the control volume (i.e., vertical expansion of the control volume) that captures the effects of the three-dimensional vortical flow structures within the wake on the fluxes. In this analysis, bottom edge of the control volume is taken to be sufficiently far below the model (outside of the field of view) with uniform free stream velocity across it. In the first measurement plane only the top-right bleed leads to horizontal flux imbalance indicating the net flow contribution to the side force even as far upstream as at the tail end of the forebody. Interestingly, the momentum flux switches sign away from the body, a signature of the coherent vortical field switch, resulting in asymptotically small net effect for the sufficiently large control volume extent (z'/D≈3.2). The evolution of the net effect for the top-right bleed at the next plane is only amplified relative to the first plane, having the final net contribution of the same sign. It is interesting to note that by the third plane, both the base flow and full azimuthal bleed begin to develop nonzero contributions to the horizontal flux; however, the net effect still asymptotes to zero far away from the body. Although a significant opposing horizontal flux is measured closer to the body, the net flux effect of the top-right bleed when the control volume extends away from the body is of the same sense as in the first two planes. While the other two configurations still do not indicate a net horizontal flux at the fourth plane, there is a complete switch in the top-right bleed contribution, which reaches the opposing sign contribution at about fourfold magnitude than in the preceding planes. This strong change in the horizontal flux is clearly attributed to the antisymmetric vortical composition of this flow field relative to the three upstream fields. Not surprisingly, another flip in the vortical composition of the flow field in the last measurement plane results in the corresponding flip in the net horizontal flux distribution. Interestingly, only at this last measurement plane, a small net contribution to the horizontal flux is seen for the base flow and for the full azimuthal bleed. Although assessed only over the five flow field snapshots, this analysis indicates that the net horizontal flux that ultimately leads to a net side force is strongly associated with the vortical wake composition, where different segment of the wake can locally impose side forces of opposing signs. Theoretically, if the forebody vortices would be shed in an antisymmetric time-periodic manner (akin to the Karman Vortex Street) along the body, it would be possible to attain a nearly zero net side force on the whole body, while body sections would be exposed to significant switching side forces along its axis. The other suggestion of the present analysis is that the net side force in the weakly asymmetric vortex 'shedding' off the axisymmetric body is predominantly associated with its tail-end wake.

Another integral measure of the controlled and uncontrolled wake evolution is based on the momentum deficit of the normal component of the freestream flow, which in a 2-D flow over a spanwise cylinder would be associated with drag. Clearly, in the present case the flow is three-dimensional, and the wake grows along the body. As already stated above, the oncoming free stream flow projection from below (outside of the measurement domain) is taken to be uniform, while the momentum flux above the body is based on the momentum variation across the body-normal coordinate z'. Thus, momentum deficit distributions with increasing distance away from the body are shown analogous to the flux distributions.

Regardless of the measured plane or the control configuration, it is clear that no asymptotic deficit is reached even farthest away from the body (z'/D≈3.2) and that, along with the wake growth along the body, each successive downstream wake section exhibits increasing momentum deficit. In addition, each of the distributions of the momentum deficit is strongly affected by the vortex-induced artifacts of the flow; namely, the local peaks of the deficit are associated with the opposing effects that the vortex pair suppresses or even reverses body-normal flow. For instance, the local momentum deficit peak at z'/D≈0.6 in the base flow is associated with the reversed flow induced by the forebody vortex pair. Further away from the body, these local peaks are typically associated with a strong wake sidewise vectoring (that also contributes to the net horizontal momentum change), such as in the base flow at z'/D≈2.1. Overall, not surprisingly, the most momentum deficit through the measured flow fields is associated with the full azimuthal bleed, as suggested by the observed wake evolution. It is interesting to note, though, that since the far wake evolutions, past the initial vortex pair detachment, are fairly similar between the base and the full-azimuthal bleed flows (compare the flow fields), this previous observation is strongly supported by the nearly overlapping distributions.

An integral measure of the flow control effect on the forebody vortex pair evolution is further sought through the estimates of evolution of each vortex circulation through the five PIV measurement planes. Based on each ensemble-averaged PIV flow field, two primary vortices are first isolated. Once the vortical bounds are set, their total circulation was calculated as an integral measure of the product of the local vorticity component $\zeta_{x'}$ and the unit area dA'=dy'dz'. The resulting circulation evolution of the forebody vortices in the base flow. As expected, circulations of both the CCW and CW vortices are of the same magnitude up to the third measurement plane. After the primary vortices become detached, its circulation weakens, while the CW circulation still remains higher than its counterpart CCW circulation. However, from the standpoint of the force exerted on the body, detached vortex influence diminishes with distance, and circulation of the secondary vortices becomes more important than the primary ones, once both of the primary vortices are detached.

Changes in circulation of the primary vortices due to the full and segmented azimuthal bleed configurations, relative to that of the base flow vortices. In either case, the base flow circulations are shown in grey as a reference. The overall effect of the full azimuthal bleed is seen in the closer balancing of the circulation magnitudes of both vortices, which is another indication of the enhanced symmetry of the flow. Although the circulation magnitudes at the first two measurement planes indicate that the total CCW and CW circulation magnitudes are increased relative to the base flow, it should be noted that these total circulations include a rather strong vorticity braids that feed off the bleed ports and are connected to the vortices and therefore become included into the vortical structure detected on either side. It is clear that without the braids, the vortices themselves do not necessarily carry more circulation than their counterparts in the base flow. This is further illuminated in the downstream evolution when the direct feed from the bleed becomes disconnected, and the results at the two most downstream planes indicate that the circulation of the controlled vortices is lower than that of the base flow. Circulation evolution is markedly different when the bleed is applied only over the 90° top-right azimuthal segment. Initially, a small increase in circulation is measured over the CCW vortex on the side of the active bleed, again enhanced by the promoted braid of vorticity from the bleed surface, while a minute reduction in the CW circulation on the opposite side might be associated with some enhanced spreading and tilting of the CW vortex pair on the opposite side. By the third measurement plane at x'/D=4, the CCW vortex is already detached and its circulation remains nearly constant to that at x'/D=2.2, while the CCW vortex remains attached and builds up circulation. By x'/D=6, the CCW vortex is mostly gone from the field of view and its circulation is consequently low, while the CW vortex becomes detached and subsequently its circulation does not get notably changed from the previous one at x'/D=4. By the last measurement plane, the CCW vortex is completely out of the field of view, while only a small remnant of the CW vortex within the field of view amounts to the low circulation magnitude. Overall, a strong imbalance in the primary vortex pair circulation around the body clearly induces a net side force, as the forebody vortices have a major contribution to the net side force.

As already noted, besides the primary forebody vortices, a secondary vortex pair forms over the body, once the primary vortex pair detaches off the surface. From the vortex contributions to the net changes in side forces, it is desired to follow and consider the vortices that are bound or close to the surface, i.e., the forebody vortices up to their lift off, and the secondary vortex pair downstream from that point. To place emphasis on the major vortical contributions to the aerodynamic forces (and moments), isolate only the vortical structures around the body at all five measurement planes, for the base and the flow controlled by the full azimuthal and 90° top-right segmented bleed. In addition, surface-tangential mean velocity profiles with respect to the wall-normal direction that pass through either vortex (marked in dashed lines) are overlaid on the plots. As such dashed lines also represent the azimuthal orientation of the vortices, it is seen that the azimuthal orientation of the forebody vortex pair remains fairly stable, with the weakening of the velocity perturbation near the surface with the vortex stretching and with their approach to detachment. Also, perturbations of both vortices remain antisymmetric and clearly indicate the equal but opposing effect. By x'/D=6, both primary vortices appear fairly diffused in the average, attributed to their increased unsteadiness. The peak velocity perturbations are displaced away from the surface, while the near-surface perturbation weakens. Finally, the vortical velocity perturbation near the surface is notably stronger on the CCW vortex side at the last measurement plane, with both vortices remaining spaced much more apart azimuthally than for the forebody vortices. Although structurally fairly similar to the base flow, there are secondary modifications of the forebody vortical perturbation of the near-surface flow when the full azimuthal bleed is applied. Along with the extended outboard reach of the perturbations, their excursions near the surface lessen, in addition to the slightly increased azimuthal spacing of the vortices. There are even more similarities of the vortical perturbations associated with the downstream fields, as the direct flow control effects terminated far upstream from these axial locations, and the convecting changes of the wake from upstream are rather mild. Lastly, as expected, velocity perturbations along the surface become notably asymmetric for the forebody vortex evolution under the segmented 90 top-right bleed. Initially, strong growth of the vortex on the bleed side induces the accordingly strong increase in the velocity along the surface on its side, while the uncontrolled-side vortex contribution does not appear much different from that of the base flow. However, further disbalance in the vortex growth affects not only the bleed-side perturbations, but also that on the opposite side, as the CW vortex begins to roll and tilt at x'/D=2.2, such that not only the CCW vortex contribution is increased relative to the base flow, but the CW vortex' opposing contribution weakens. By the next measurement plane, not only that there is an imbalance in velocities near the surface but the vortex pair becomes tilted to the bleed side, further increasing the uneven net contribution to the aerodynamic side force. This observed tilt completely changes after detachment of the CW primary vortex, when the perturbation balance switches side. Nonetheless, velocity perturbations near the surface seem to be rather small. Lastly, it appears that the phase delay between the secondary vortex formations on the cylinder sides increases by the last measurement plane and the vortex pair azimuthal switch to the opposite side appears incomplete.

After the initial study of the bleed flow control effectiveness presented above, the bleed configuration about the forebody was redesigned, keeping the same porosity. To check for the resulting flow control effectiveness, a sweep in the body pitch angles was performed first, ranging from $35° < \alpha < 55°$. The two configurations inducing the largest excursions in the side force are first tested at each pitch angle—a 90° azimuthal segment positioned at the top right and left, i.e., directly affecting only the CCW and CW vortex, respectively. In principle, both the effect on drag and lift should not depend on the side at which the bleed control is applied. While the lift data are practically overlapped for the right-and left-side flow control, there is a small by consistent offset in the drag results. As for the most interesting aerodynamic effect—the side force, progressively increasing side force is achieved with the pitch angle, with the sign defined by the side of the bleed control application. The difference relative to the results shown is that the side force coefficients reach or even exceed $C_S$=4, which nearly match the lift coefficient at higher angles of attack. Some discrepancy in the attained magnitudes for the opposite-side actuation can be attributed to the non-zero base flow side force, i.e., to the fact that the base flow is biased towards the one-side asymmetry (that results in the net positive $C_S$ in this case) in the absence of the flow control. As almost exclusive change in the aerodynamic forces is in the side force direction, the associated moments change is in the yaw (in the fixed coordinate system). Some discrepancy in the pitch moments that result from the bleed control by the top right and top left orientations are the direct consequence of the offset in drag.

Similar to the earlier analysis of the effects of the two characteristic bleed configurations, the representatives of the bleed control configurations that promote the flow symmetry (full azimuthal bleed) and asymmetry (top-right 90° bleed segment), are also assessed with the revised bleed configuration, with addition of the base flow, as a reference case. Hence, the corresponding evolution of the lift, drag and side force coefficients with angle of attack can be shown for the baseline flow and the bleed configurations, while the corresponding changes in pitch and yaw moments. As expected, both $C_D$ and $C_L$ increase monotonically over most of the range of a, where the rate of increase in $C_L$ begins to diminish past $\alpha > 45°$ as the forebody vortices begin to lift off the cylinder surface and the flow from the windward separates on its leeward surface. The side force coefficient $C_S$ in the base flow is nearly zero as long as there is no major asymmetry in the evolution of the forebody vortices, but when the symmetry breaks for $\alpha > 45°$, there is an increase in the magnitude of the net side force. Since for this forebody the CCW vortex is the first to become detached from the surface, the net side force is negative. The symmetry-enforcing full circumferential azimuthal bleed is therefore expected to alleviate some of the net side force of the base flow, which is particularly evident at these high inclination angles. Along with the reduction in the side force, this bleed actuation also slightly reduces both the lift and drag at these high a. Finally, as expected, the strong flow asymmetry induced by the segmented bleed is accompanied by a strong net side force whose magnitude increases with a, while the lift and drag remain nearly unchanged relative to the base flow. The benefits of the full azimuthal bleed are presumably even better expressed in the net yaw moment, where the increasing yaw moment of the base flow for higher elevation angles becomes diminished back to zero under the full azimuthal bleed control.

Dynamic Azimuthal Forebody Bleed for Regulation of the Side Forces

After the preliminary studies on utilization of the forebody aerodynamic bleed on the model's aerodynamic loads, were concluded, an active control device was devised that can be controlled remotely and tailor the bleed control in real time. For that purpose, a miniature rotary motor is integrated into the model having an azimuthal step resolution of 0.17. The motor shaft is extended such to connects to an internal conical segment with partition azimuthal opening (hereinafter referred to as a valve) that is inserted in the forebody and it is positioned under the outer shell that is populated with arrays of bleed ports. Two outer shells for the two bleed configurations are designed—the coarser (1×) and the finer (0.5×) one. In addition, two valve configurations are tested as well, one with the segmented path, which forces both the bleed in and bleed out flows over that single side of the outer shell surface, and the flow-through path that nominally forces a directional bleed path, from the higher-pressure side surface to the opposite. It should be noted that, opposite to the prior bleed configuration that comprised of the outer shell, there is no fully closed configuration (no bleed), as the bleed pattern on the outer shell is fully distributed across the azimuth and there is a segment of the that surface that is always open for bleed, depending on the inner shell valve orientation.

A typical change in the aerodynamic loads in the body-axial and side directions, $C_A$ and $C_S$, respectively, for all the four combinations of the forebodies and valves. In each set of experiments, the model is set at the pitch angle $\alpha=45°$ and the valve is initially positioned at $\theta=0°$, i.e., at the bottom on the windward side. After the set of measurements is taken, the valve orientation is incremented in q and the next set of measurements is acquired. This process is repeated until the valve central reference point traverses full 360°. These full azimuthal changes in these two aerodynamic loads can be shown. While the dominant change is in the side force magnitude, there is typically smaller, pseudo-periodic variation in the axial force as well, approximately alternating every quadrant of the valve motion, having the minima lined with the starting valve orientation. The largest effect is certainly seen in the side force, in accord with the initial discussion of the aerodynamic bleed effect above. When assessing the differences between the coarse (1×) and refined (0.5×) bleed distributions, for a single path valve, there is somewhat more variations for a finer distribution, although, in principle, aerodynamic behavior is quite similar. This is even more pronounced for the dual-path valve, where the primary modification is expressed through the extended leveling of the peak positive and negative force azimuthal extents for the finer bleed distribution. Lastly, the most pronounced difference is seen in comparison between the single and dual-path inner shells. While the peak magnitudes of the forces do not differ significantly, the period of the side force doubles for the dual-path valve, as reflected in the four angles about which the force changes sign, relative to the single-path configuration that has two such locations.

These zero-crossings are particularly important from the standpoint of flow control, as they define regions over which the bi-directional control should be centered about. One such region can be highlighted, which is centered about the zero crossing at $\theta_o=180.5°$. The steep slope $dCs/d\theta$ enables a high sensitivity to the valve angular changes, such that the full effect in either direction can be attained by displacement of only about ±14° in either direction about the $\theta_o$. As an example, the peak positive side force ($C_S\approx2.05$) is attained at $\theta_1=193°$, while the peak negative force ($C_S\approx-1.77$) corresponds to $\theta_2=168°$.

Another important parameter for a quick control application is the flow response to the control input, expressed through the altered aerodynamic loads. To test how fast the flow responds to the bleed control, the valve is commanded to periodically switch between the two end states, yielding the maximum force in either direction, i.e., between $\theta=168°$ and 193°. Initially, the valve switched between the two states after staying at each end state for 5 s, i.e., having the period of 0.1 Hz. Two switches associated between the two extremes, having the valve position in blue and the corresponding side force signal in red. In addition, the two transitions are emphasized by arrows. Clearly, after maintaining a constant side force during each 5 s half-period, the step-on change in the valve angular position is closely followed by the force switch without any discernable delay. It is noted, though that the valve commanded step-on motion is realized as slightly underdamped, having a single overshoot-undershoot before settling at the desired angular position. This initial valve-motion response is also reflected in the side-force response, which becomes more pronounced with an increase in the switch frequency. While the force response for f=0.25 Hz does not significantly differ from that at f=0.1 Hz, increasing the frequency to f=0.5 Hz, indicates that the force response during the 1 s stays at each extreme yields the force component having a clear resonant system frequency of about 7 Hz. This becomes pronounced even stronger when the frequency is further quadrupled and the 'stay' time corresponds to not even the full two periods of the natural frequency of the system.

Lastly, a sample of the controlled side force without the feedback control loop can be shown, where the pitch angle of the model is varied between $\alpha=30°$ and 60° in increment of 5°. At each of these pitch angles, the single-path valve is adjusted about the top zero-crossing position such that the resulting controlled side force is kept close to zero. At each of the zero-force states, the corresponding angular position of the valve is recorded as well. The resulting controlled states indicate the controlled states closely following zero up to $\alpha=50°$, while being somewhat relaxed at the two highest pitch orientations. Overall, a close following of the targeted zero force state is realized. While examining the bleed-valve orientations that facilitated such states, another close following of the $\theta=180°$ orientation is observed, with most of the departures being within ±3° away from the top orientation.

Summary

These investigations focused on exploiting segmented porosity over the platform's forebody for not only suppression of asymmetric side forces that arise from flow's receptivity to minor imperfections of the body surface but, more importantly for prescribing desired side forces and yawing moment for bi-directional aerodynamic control.

It was shown that segmented azimuthal bleed actuation over the forebody can lead to significant changes in the evolution and symmetry of the forebody vortex pair that are accompanied by controllable side forces of prescribed sense and magnitude. Bleed control can be used to overrides naturally evolving forebody flow asymmetries and can either amplify the resulting induced loads or suppress them by manipulation of the forebody vortices. This finding is of particular significance considering the receptivity of the base forebody flow to small surface and flow nonuniformities. Depending on the angle of incidence, bleed-induced side force coefficient increments as high as $\Delta C_S = \pm 3.5$, depending on the pitch incidence, could be attained where, by comparison, the corresponding 'vertical (lift) coefficient is $C_L \approx 4.5$.

The wake flow features associated with the base and controlled realizations of the aerodynamic loads were elucidated using successive PIV measurements that revealed the evolution of streamwise vortical structures along the body. It was shown that weakly asymmetric forebody vortices in the base flow, primarily induce the unbalanced side loads over the downstream end of the body, following the first forebody vortex detachment. Full azimuthal bleed control altered the vortical evolution over the forebody by the equal vortex displacement off the body and thereby severing the off-surface vorticity influx, while maintaining the left-to-right flow symmetry. In contrast, segmented one-sided bleed directly affected the adjacent forebody vortex, inducing an aerodynamic imbalance while the opposite side vortex responded to the wake of the detached vortex by tilting in its direction. The detachment of the primary vortices was followed by successive rollup and interactions of secondary vortices along the cylinder's wake.

The main implementation of this actuation technology is the development of a unique approach for activation of dynamic, time-dependent segmented bleed actuation that enables tailoring of bleed control in real time. In this configuration, an internal rotary shell underneath a forebody shell with prescribed bleed port pattern prescribed which azimuthal segment of the forebody was open for aerodynamic bleed. The objective of this final stage of the project was to completely bypass any naturally, and unpredictably, evolving state of the flow over the axisymmetric body at high incidence, which would typically result in a net side force (and the yawing moment) of either sign. Instead, the actuation approach was to set to realize side forces of prescribed sense and magnitude over a range of incidence angles including complete suppression of the side force. As part of these concluding investigations two different forebody porosities and two different bleed valves were tested and the interactions of the bleed with the cross flow were characterized through the realized aerodynamic loads and their sensitivity to variations of the azimuthal position of the valve $\partial Cs/\partial\theta$ as well as the characteristic response time to a step change in the bleed control input. These investigations showed that for one-or two-way bleed configurations, there are either two or four azimuthal bleed orientations about which the side force changes sign demonstrating broad dynamic control authority over of the side forces over a broad range of angles of incidence.

The disclosed technology can be further understood according to the following clauses:

Clause 1: A system for controlling aerodynamic loads on an aerostructure, comprising: an outer shell comprising at least one aperture; an inner shell having an aperture therethrough, the aperture extending azimuthally around a portion of the inner shell; and an actuator configured to control a rotational alignment of the inner shell and the outer shell to alter aerodynamic bleed through at least a portion of at least one aperture of the outer shell.

Clause 2: The system of Clause 1, wherein the actuator comprises a motor configured to axially rotate at least one of the inner shell and the outer shell.

Clause 3: The system of Clause 2, wherein the outer shell is rotationally fixed to the aerostructure, and wherein the motor is configured to axially rotate the inner shell with respect to the outer shell.

Clause 4: The system of Clause 1, wherein the outer shell is disposed on an end of the aerostructure.

Clause 5: The system of Clause 1, wherein at least one aperture of the outer shell is part of an array of apertures azimuthally distributed on the outer shell.

Clause 6: The system of Clause 5, wherein at least one aperture of the outer shell comprises at least one straight edge, and the aperture of the inner shell comprises at least one straight edge, such that the at least one straight edge of the outer shell is configured to align with the at least one straight edge of the inner shell.

Clause 7: The system of Clause 6, wherein the array of apertures comprises a first row of apertures and a second row of apertures, wherein at least one aperture of the first row is aligned with at least one aperture of the second row substantially parallel to a longitudinal axis of the aerostructure.

Clause 8: The system of Clause 1, wherein the actuator is configured to cause the inner shell to transition between a first rotational alignment with the outer shell in which the inner shell blocks aerodynamic bleed through at least a portion of at least one aperture of the outer shell and a second rotational alignment with the outer shell in which the inner shell allows aerodynamic bleed through the at least a portion of the at least one aperture of the outer shell.

Clause 9: The system of Clause 1, wherein the actuator is configured to control the rotational alignment of the inner shell and the outer shell based at least in part on a side force component from a fluid flow on the aerostructure.

Clause 10: The system of Clause 1, wherein at least one aperture of the outer shell is part of a plurality of apertures spanning a top azimuthal portion of the outer shell.

Clause 11: The system of Clause 10, wherein the inner shell is part of a plurality of inner shells comprising a first inner shell and a second inner shell, wherein the first inner shell and the second inner shell overlap thereby forming a relative azimuthal aperture.

Clause 12: The system of Clause 1, wherein the actuator is selected from a group consisting of: a rotary motor, an inflatable actuator, piezoelectric plates, and an electrostatic actuator.

Clause 13: The system of Clause 1, wherein the actuator is configured to automatically control the rotational alignment of the inner shell and the outer shell based at least in part on a desired steering direction of the aerostructure.

Clause 14: An aerostructure comprising: a substantially cylindrical body; and a forebody section comprising: an outer shell comprising an array of apertures; and an inner shell having one or more apertures therethrough, the one or more apertures extending azimuthally around a portion of the inner shell; and an actuator configured to control a rotational alignment of the inner shell and outer shell, such that the rotational alignment is configured to alter aerodynamic bleed through at least a portion of at least one aperture of the outer shell.

Clause 15: The aerostructure of Clause 14, wherein the forebody section further comprises a gap disposed between the outer shell and the inner shell.

Clause 16: The aerostructure of Clause 14, wherein the outer shell and the inner shell are hollow, such that the forebody section further comprises a compartment disposed at least partially within the inner shell.

Clause 17: The aerostructure of Clause 14, wherein the inner shell is part of a plurality of inner shells comprising a first inner shell and a second inner shell, wherein the first inner shell and the second inner shell overlap thereby forming a relative azimuthal aperture.

Clause 18: A method of controlling aerodynamic loads on an aerostructure, the aerostructure comprising an outer shell, the outer shell comprising at least one aperture, and an inner shell having an aperture therethrough, the aperture extending azimuthally around a portion of the inner shell, the method comprising: placing the aerostructure in motion, such that the aerostructure experiences aerodynamic loads; and altering a rotational alignment of the inner shell with respect to the outer shell to alter aerodynamic bleed through at least one aperture of the outer shell.

Clause 19: The method of Clause 18, wherein altering the rotational alignment of the inner shell with respect to the outer shell comprises: substantially nullifying effects of side forces and yawing moments via a first rotational alignment adjustment; determining a desired directional change of the aerostructure; and making a second rotational alignment adjustment based at least in part on the desired directional change of the aerostructure.

Clause 20: The method of Clause 18, wherein altering the rotational alignment of the inner shell with respect to the outer shell to alter aerodynamic bleed through at least one aperture of the outer shell comprises altering an azimuthal position of the aperture of the inner shell.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way.

What is claimed is:

1. A system for regulation of aerodynamic loads comprising:

an outer shell comprising at least one aperture;

a first inner shell having an aperture therethrough;

a second inner shell having an aperture therethrough; and an actuator;

wherein:

the respective inner shell apertures extend azimuthally around a portion of the respective inner shell;

the first inner shell and the second inner shell overlap, such that the inner shell apertures form a relative azimuthal aperture; and the actuator is configured to control a rotational alignment of the inner shells and the outer shell to alter aerodynamic bleed through at least a portion of at least one aperture of the outer shell.

2. The system of claim 1, wherein the actuator comprises a motor configured to axially rotate at least one of the first inner shell, the second inner shell, or the outer shell.

3. The system of claim 2, wherein:

the outer shell is rotationally fixed to an aerostructure; and the motor is configured to axially rotate at least one of the first inner shell or the second inner shell with respect to the outer shell.

4. The system of claim 3, wherein the outer shell is disposed on an end of the aerostructure.

5. The system of claim 1, wherein at least one aperture of the outer shell is part of an array of apertures azimuthally distributed on the outer shell.

6. The system of claim 1, wherein:

at least one aperture of the outer shell comprises at least one straight edge;

the relative azimuthal aperture of the overlapping inner shells comprises at least one straight edge; and the at least one straight edge of the aperture of the outer shell is configured to align with the at least one straight edge of the relative azimuthal aperture of the overlapping inner shell.

7. The system of claim 5, wherein:

the array of apertures azimuthally distributed on the outer shell comprise a first row of apertures and a second row of apertures; and at least one aperture of the first row is aligned with at least one aperture of the second row substantially parallel to a longitudinal axis of the aerostructure.

8. The system of claim 1, wherein the actuator is further configured to transition at least one of the first inner shell or the second inner shell between;

a first rotational alignment with the outer shell in which at least one of the first inner shell or the second inner shell blocks aerodynamic bleed through at least a portion of at least one aperture of the outer shell; and a second rotational alignment with the outer shell that allows aerodynamic bleed through the at least a portion of the at least one aperture of the outer shell.

9. The system of claim 1, wherein:

the outer shell is rotationally fixed to an aerostructure; and the actuator is further configured to control the rotational alignment based, at least in part, on a side force component from a fluid flow on the aerostructure.

10. The system of claim 1, wherein at least one aperture of the outer shell is part of a plurality of apertures spanning a top azimuthal portion of the outer shell.

11. The system of claim 1, wherein the actuator is selected from a group consisting of a rotary motor, an inflatable actuator, piezoelectric plates, and an electrostatic actuator.

12. The system of claim 1, wherein the actuator is further configured to automatically control the rotational alignment based, at least in part, on a desired steering direction of the aerostructure.

13. An aerostructure comprising:

a substantially cylindrical body; and a forebody section comprising:

an outer shell comprising an azimuthally distributed array of bleed ports;

a first inner shell having one or more apertures therethrough;

a second inner shell having one or more apertures therethrough; and an actuator;

wherein:

the first inner shell and the second inner shell overlap, such that at least one aperture of the first inner shell and at least one aperture of the second inner shell form a relative azimuthal aperture;

the actuator is configured to control a rotational alignment of the inner shells and outer shell, such that the rotational alignment is configured to alter aerodynamic bleed through at least a portion of the bleed ports of the outer shell.

14. The aerostructure of claim 13, wherein the forebody section further comprises a gap disposed between the outer shell and the first inner shell.

15. The aerostructure of claim 13, wherein:

at least one of the first inner shell or the second inner shell is hollow, such that the forebody section further comprises a compartment disposed at least partially within at least one of the first inner shell or the second inner shell.

16. A method of regulating aerodynamic loads on an aerostructure experiencing aerodynamic loads while in motion, the aerostructure comprising an outer shell having at least one aperture, a first inner shell having an aperture therethrough, and a second inner shell having an aperture therethrough, the respective inner shell apertures extending azimuthally around a portion of the respective inner shell, the first inner shell and the second inner shell overlapping, such that the inner shell apertures form a relative azimuthal aperture, the method comprising:

altering a rotational alignment of the inner shells with respect to the outer shell to alter aerodynamic bleed through at least one aperture of the outer shell.

17. The method of claim 16, wherein the altering comprises:

substantially nullifying effects of side forces and yawing moments via a first rotational alignment adjustment;

determining a desired directional change of the aerostructure; and making a second rotational alignment adjustment based, at least in part, on the desired directional change of the aerostructure.

18. The method of claim 16, wherein the altering comprises altering a position of the relative azimuthal aperture.

19. The system of claim 1, wherein:

a first gap is disposed between the outer shell and the first inner shell; and a second gap is disposed between the first inner shell and the second inner shell.

20. The system of claim 1, wherein:

the inner shells are hollow; and a compartment is disposed at least partially within at least one of the first inner shell or the second inner shell.

* * * * *